US011466936B2

(12) United States Patent
Kitagawa et al.

(10) Patent No.: US 11,466,936 B2
(45) Date of Patent: Oct. 11, 2022

(54) HEAT EXCHANGER

(71) Applicant: DENSO CORPORATION, Kariya (JP)

(72) Inventors: Shinya Kitagawa, Kariya (JP); Takahiro Uno, Kariya (JP); Kenichi Kachi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/140,889

(22) Filed: Jan. 4, 2021

(65) Prior Publication Data

US 2021/0123681 A1 Apr. 29, 2021

Related U.S. Application Data

(63) Continuation of application No. PCT/JP2019/028199, filed on Jul. 18, 2019.

(30) Foreign Application Priority Data

Jul. 25, 2018 (JP) ..... JP2018-139522
Mar. 18, 2019 (JP) ..... JP2019-050143
Jul. 16, 2019 (JP) ..... JP2019-130870

(51) Int. Cl.
*F28D 1/053* (2006.01)
*F28F 1/30* (2006.01)

(52) U.S. Cl.
CPC ..... *F28D 1/053* (2013.01); *F28F 1/30* (2013.01)

(58) Field of Classification Search
CPC ... F28D 1/053; F28F 1/20; F28F 1/128; F28F 1/30
USPC ..... 165/172
See application file for complete search history.

(56) References Cited

U.S. PATENT DOCUMENTS 3,693,710 A * 9/1972 Drosnin ..... F28F 1/126 165/152
4,311,193 A * 1/1982 Verhaeghe ..... F28F 1/128 165/149
6,354,368 B1 * 3/2002 Nishishita ..... F28D 1/0435 165/135
7,913,750 B2 * 3/2011 Huang ..... F28F 1/128 165/152

(Continued)

FOREIGN PATENT DOCUMENTS

DE 102006000634 A1 7/2007
JP H11142079 A 5/1999

(Continued)

*Primary Examiner* — Devon Russell
(74) *Attorney, Agent, or Firm* — Harness, Dickey & Pierce, P.L.C.

(57) ABSTRACT

A heat exchanger includes multiple tubes and multiple fins. Each of the tubes has a tubular shape extending in a horizontal direction. Each of the fins is disposed between adjacent ones of the tubes in a vertical direction vertical to the horizontal direction. Each of the fins is corrugated and includes bent portions located near the adjacent ones of the tubes and flat plate portions each of which extends in the vertical direction to connect between two of the bent portions. Each of the fins includes a pair of slits and an offset portion. At least a portion of the pair of slits extends to one of the bent portions. The offset portion is formed by having a portion of each of the fins between the pair of slits recessed inward of the one of the bent portions.

12 Claims, 18 Drawing Sheets

(56) References Cited

U.S. PATENT DOCUMENTS

| | | | | |
|---|---|---|---|---|
| 2003/0196324 | A1* | 10/2003 | Hunt | F28F 1/128<br>29/890.046 |
| 2004/0069457 | A1* | 4/2004 | Park | F28F 1/126<br>165/104.21 |
| 2005/0077033 | A1* | 4/2005 | Schmalzried | F28F 1/126<br>165/152 |
| 2007/0012430 | A1* | 1/2007 | Duke | F28F 1/128<br>165/109.1 |
| 2012/0227945 | A1* | 9/2012 | Taras | F28F 17/005<br>165/172 |
| 2013/0068438 | A1* | 3/2013 | Matsumoto | F28D 1/05366<br>165/183 |
| 2015/0034289 | A1* | 2/2015 | Seo | F28F 1/12<br>165/173 |

FOREIGN PATENT DOCUMENTS

| | | | |
|---|---|---|---|
| JP | 2010025481 | A | 2/2010 |
| JP | 2012-032111 | A | 2/2012 |

* cited by examiner

HEAT EXCHANGER

CROSS REFERENCE TO RELATED APPLICATIONS

The present application is a continuation application of International Patent Application No. PCT/JP2019/028199 filed on Jul. 18, 2019, which designated the U.S. and claims the benefit of priority from Japanese Patent Application No. 2018-139522 filed on Jul. 25, 2018, Japanese Patent Application No. 2019-050143 filed on Mar. 18, 2019, and Japanese Patent Application No. 2019-130870 filed on Jul. 16, 2019. The entire disclosures of all of the above applications are incorporated herein by reference.

TECHNICAL FIELD

The present disclosure relates to a heat exchanger configured to exchange heat between a heat medium and an air.

BACKGROUND

A heat exchanger, such as an evaporator disposed in a heat pump system, receives heat from an air through a heat exchange between the air and a heat medium such as a refrigerant. The heat exchanger is configured to exchange heat between a low-temperature heat medium flowing through tubes and an air flowing outside of the tubes.

SUMMARY

A heat exchanger of the present disclosure is configured to exchange heat between a heat medium and an air. The heat exchanger includes multiple tubes and multiple fins. Each of the multiple tubes has a tubular shape extending in a horizontal direction and the heat medium flows through the tubes. Each of the multiple fins is disposed between adjacent ones of the tubes in a vertical direction vertical to the horizontal direction. Each of the fins is corrugated and includes bent portions and flat plate portions. The bent portions are located near the adjacent ones of the tubes. Each of the flat plate portions substantially extends in the vertical direction to connect between two of the bent portions. Each of the fins includes a pair of slits and an offset portion. A part of the pair of slits extends to one of the bent portions. The offset portion is formed into a dented shape by having a portion of each of the fins between the pair of slits recessed inward of the one of the bent portions.

DESCRIPTION OF EMBODIMENTS

Figure 1:
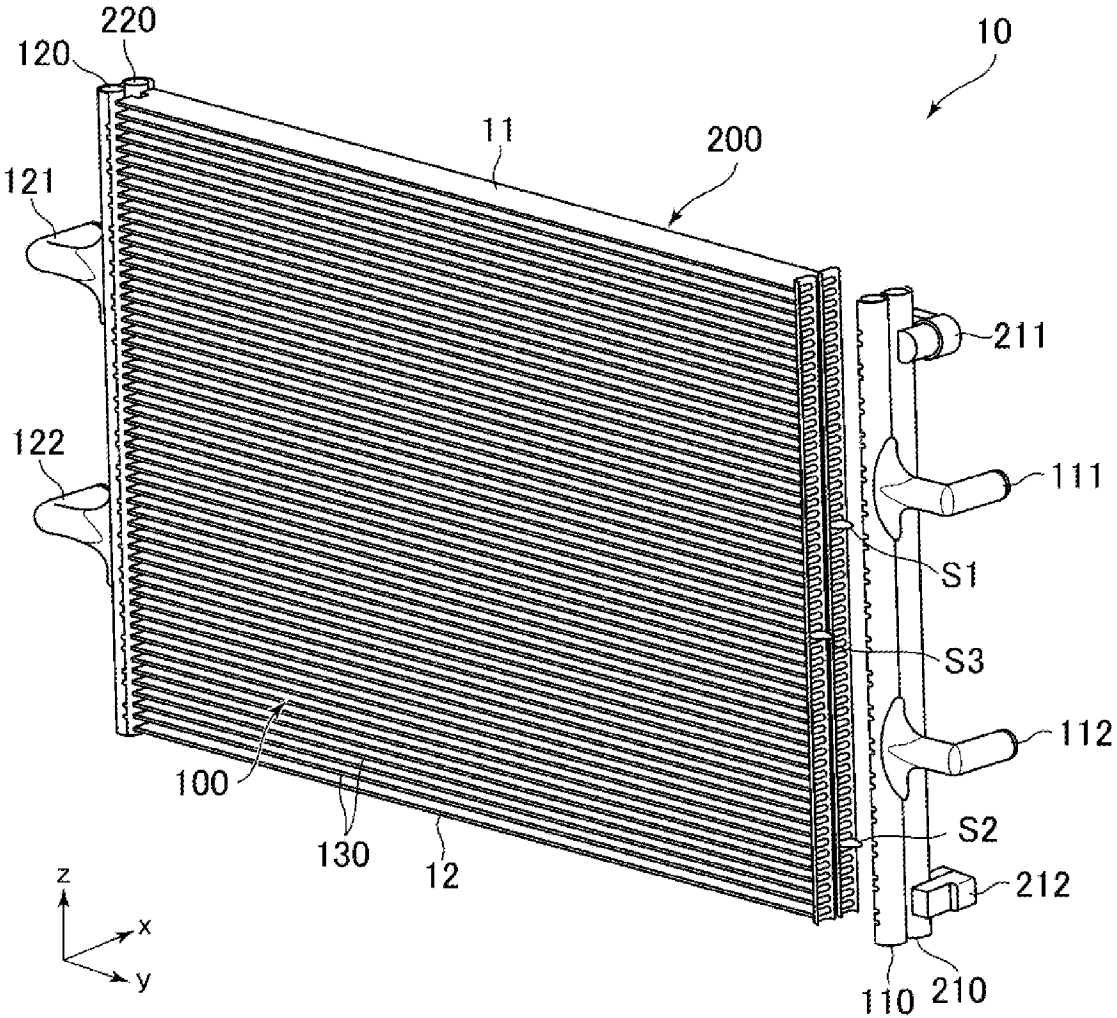
FIG. 1 is a diagram illustrating an overall configuration of a heat exchanger of a first embodiment.

To begin with, examples of relevant techniques will be described.

A heat exchanger, such as an evaporator disposed in a heat pump system, receives heat from an air through a heat exchange between the air and a heat medium such as a refrigerant. The heat exchanger is configured to exchange heat between a low-temperature heat medium flowing through tubes and an air flowing outside of the tubes.

The air passing through the heat exchanger contains water vapor. Thus, when the air is cooled while flowing outside of the tubes, the water vapor in the air is condensed and adheres to surfaces of the tubes and fins. The condensed water may become a frost and the frost may cover the surfaces of the tubes and the fins.

The condensed water described above and water generated when the frost melts are all referred to as "condensed water". When the condensed water stays with adhered to the surfaces of the tubes and the fins, the condensed water restricts the air from passing through the heat exchanger. In particular, it is difficult for the heat exchanger in which the tubes extend in a horizontal direction to discharge the condensed water with the gravity. Thus, the condensed water is likely to stay as described above.

Therefore, a heat exchanger defining a through hole at a part of each of the fins has been known and the condensed water is discharged out through the through holes.

However, in the heat exchanger, heat transfer areas of the fins are reduced due to the through holes. In addition, when forming such fins, it is necessary to remove material located in positions to be the through holes. However, when the fins are formed with a roller in a conventional way, it is difficult to clear the removed material.

It is objective of the present disclosure to provide a heat exchanger that improves a drainage of condensed water without reducing the heat transfer area of fins.

A heat exchanger of the present disclosure is configured to exchange heat between a heat medium and an air. The heat exchanger includes multiple tubes and multiple fins. Each of the multiple tubes has a tubular shape extending in a horizontal direction and the heat medium flows through the tubes. Each of the multiple fins is disposed between adjacent ones of the tubes in a vertical direction vertical to the horizontal direction. Each of the fins is corrugated and includes bent portions and flat plate portions. The bent portions are located near the adjacent ones of the tubes. Each of the flat plate portions substantially extends in the vertical direction to connect between two of the bent portions. Each of the fins includes a pair of slits and an offset portion. A part of the pair of slits extends to one of the bent portions. The offset portion is formed into a dented shape by having a portion of each of the fins between the pair of slits recessed inward of the one of the bent portions.

The heat exchanger having such configuration has a pair of slits at a part of each of the fins and an offset portions is formed by having a part of each of the fins between the pair of slits recessed inward of the one of the bent portions. Since the offset portion defines an opening, the condensed water adhered to the fins can be discharged out through the opening.

The opening is defined by having the part of each of the fins between the pair of slits recessed inward of the one of the bend portion. It is unnecessary to remove a part of material constituting the fins for defining the opening. Thus, the pair of slits and the offset portion can be formed by a roller using the same method for forming louvers.

According to the present disclosure, a heat exchanger that can improve a drainage of condensed water without reducing a heat transfer area of fins is provided.

Hereinafter, the present embodiments will be described with reference to the attached drawings. In order to facilitate the ease of understanding, the same reference numerals are attached to the same constituent elements in each drawing where possible, and redundant explanations are omitted.

With reference to mainly FIG. 1, a configuration of a heat exchanger 10 of a first embodiment will be described. The heat exchanger 10 is a heat exchanger mounted in a vehicle (not shown) and configured as a combined heat exchanger including a radiator 100 and an evaporator 200.

The radiator 100 is a heat exchanger configured to cool a cooling water, which is temperature-increased by a heat generator (not shown), through a heat exchange between the cooling water and an air. "The heat generator" is a device that is mounted in the vehicle and needs to be cooled. For example, the heat generator is an internal combustion engine, an intercooler, a motor, an inverter, and a battery. The evaporator 200 is a part of an air conditioner (not shown) mounted in the vehicle. The evaporator 200 is a heat exchanger configured to evaporate a liquid phase refrigerant through a heat exchange between the air and the refrigerant. As described above, the heat exchanger 10 is configured to exchange heat between a heat medium and air. The cooling water corresponds to "the heat medium" in the radiator 100 and the refrigerant corresponds to "the heat medium" in the evaporator 200.

At first, a configuration of the radiator 100 will be described. The radiator 100 includes a pair of tanks 110 and 120, tubes 130, and fins 300. In FIG. 1, illustration of the fins 300 are omitted.

The tanks 110 and 120 are both containers for temporarily storing the cooling water that is the heat medium. Each of the tanks 110 and 120 is a long and thin container having an approximately cylindrical pillar shape and arranged such that longitudinal directions of the tanks 110, 120 are positioned along a vertical direction. The tanks 110 and 120 are arranged at positions separated from each other in a horizontal direction, and the tubes 130 and fins 300 which will be described later are arranged between the tanks 110 and 120.

The tank 110 is integrally formed with a tank 210 of the evaporator 200. Similarly, the tank 120 is integrally formed with a tank 220 of the evaporator 200. FIG. 1 is a schematic view illustrating a state in which the tank 110 and the tank 210 are detached from the heat exchanger 10 in order to illustrate inner configurations of the tank 110 and the tank 210.

The tank 110 includes receiving portions 111 and 112. The receiving portions 111 and 112 are portions to receive the cooling water having passed through the heat generator. The receiving portion 111 is located in an upper portion of the tank 110. The receiving portion 112 is located in a lower portion of the tank 110.

As shown in FIG. 1, a separator S3 divides an inner space of the tank 110 into an upper space and a lower space. The cooling water supplied from the receiving portion 111 flows into the upper space in the inner space of the tank 110 that is defined on an upper side of the separator S3. The cooling water supplied from the receiving portion 112 flows into the lower space in the inner space of the tank 110 that is defined on a lower side of the separator S3.

The tank 120 includes discharge portions 121 and 122. The discharge portions 121 and 122 are disposed to discharge outward the cooling water having heat-exchanged. The discharge portion 121 is located in an upper portion of the tank 120. The discharge portion 122 is located in a lower portion of the tank 120.

Inside the tank 120, a separator similar to the separator S3 is disposed at a position in the same height as that of the separator S3. The separator divides an inner space of the tank 120 into an upper space and a lower space. The cooling water flowing into the upper space of the inner space that is located on an upper side of the separator is discharge out through the discharge portion 121. The cooling water flowing into the lower space of the inner space that is located on a lower side of the separator is discharged out through the discharge portion 122.

The tubes 130 are tubular member through which the cooling water flows therein. The radiator 100 includes multiple tubes 130. Each of the tubes 130 is an elongated straight tube and extends in the horizontal direction. Each of the tubes 130 has one end fluidly connected to the tank 110 and the other end fluidly connected to the tank 120. Thereby, the inner space of the tank 110 is fluidly connected to the inner space of the tank 120 through the tubes 130.

The tubes 130 are stacked in the vertical direction, that is a longitudinal direction of the tank 110 and the like. Each of the fins 300 is disposed between adjacent ones of the tubes 130 in the vertical direction, but the illustration of the fins 300 are omitted in FIG. 1.

The cooling water supplied into the tank 110 from an outside of the tank 110 flows into the tank 120 through the tubes 130. The cooling water is cooled by the air flowing through outside of the tubes 130 while flowing through inside of the tubes 130. An airflow direction in which the air passes through the heat exchanger 10 is a direction perpendicular to both the longitudinal direction of the tank 110 and the longitudinal direction of the tubes 130. The airflow direction is a direction from the radiator 100 to the evaporator 200. A fan (not shown) configured to send the air in the airflow direction is disposed near the heat exchanger 10. The fins 300 are corrugated fins formed by bending a metal plate into a wave shape.

As described above, each of the fins 300 are located between the adjacent ones of the tubes 130 in the vertical direction. That is, in the radiator 100, the fins 300 and the tubes 130 are alternately arranged in the vertical direction.

Figure 2:
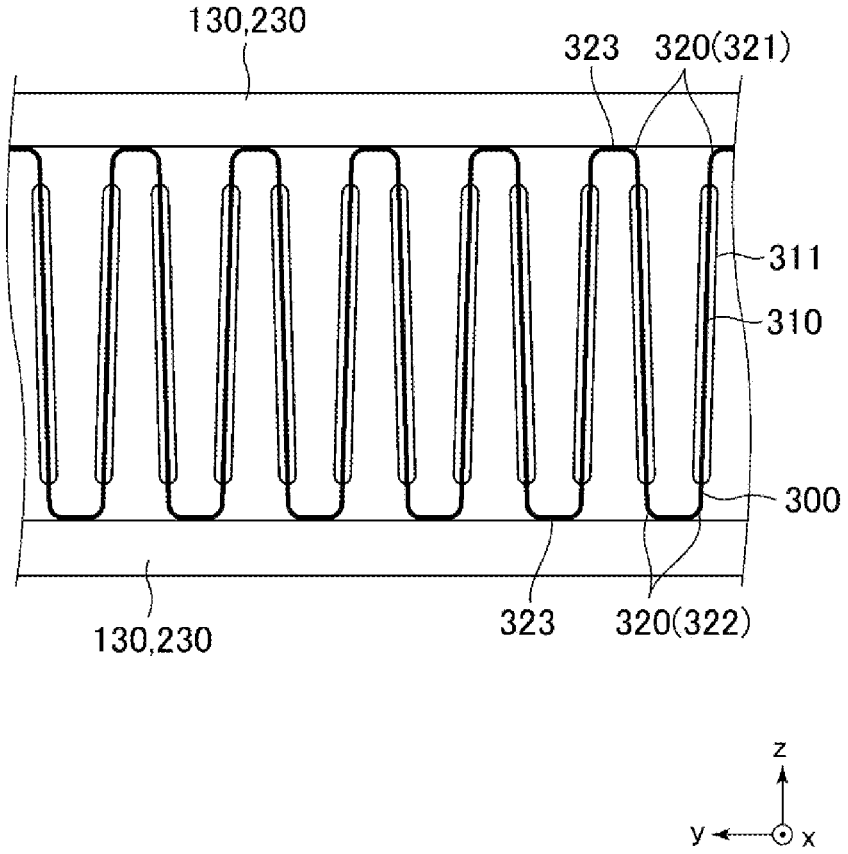
FIG. 2 is a diagram of a fin and tubes disposed an upper side and a lower side of the fin of the heat exchanger.

As shown in FIG. 2, each of the corrugated fins 300 includes peaks and the peaks are in contact with and brazed to surfaces of the adjacent ones of the tubes 130 in the vertical direction.

When the cooling water flows through inside of the tubes 130, the heat of the cooling water is transferred to the air through the tubes 130 and through the tubes 130 and fins 300. That is, the fins 300 increase contact areas of the fins 300 with the air, thereby improving an efficiently of the heat exchange between the air and the cooling water.

Next, a configuration of the evaporator 200 will be described. The evaporator 200 includes a pair of tanks 210, 220, tubes 230, and the fins 300.

The tanks 210 and 220 are containers configured to temporarily store the refrigerant that is the heat medium. Each of the tanks 210 and 220 is a long and thin container having an approximately cylindrical pillar shape and arranged such that longitudinal directions of the tanks 210, 220 are positioned along a vertical direction. The tanks 210 and 220 are arranged at positions separated from each other in the horizontal direction and the tubes 230 and the fins 300 are disposed therebetween.

As described above, the tank 210 is integrally formed with the tank 110 of the radiator 100. Similarly, the tank 220 is integrally formed with the tank 120 of the radiator 100.

The tank 210 includes a receiving portion 211 and a discharge portion 212. The receiving portion 211 receives the refrigerant circulating through the air conditioner. The liquid phase refrigerant that has a low temperature after flowing through an expansion valve (not shown) of the air conditioner is supplied into the receiving portion 211. The receiving portion 211 is disposed at a position closer to an upper end of the tank 210. The discharge portion 212 is a portion through which the refrigerant having heat-exchanged flows out. The gas-phase refrigerant evaporated by the heat exchange in the evaporator 200 flows out through the discharge portion 212 and is supplied into a compressor (not shown) of the air conditioner.

As shown in FIG. 1, an inner space of the tank 210 is divided into three spaces by separators S1 and S2. The receiving portion 211 is disposed on an upper side of the separator S1 that is located on an upper side of the separator S2. The discharge portion 212 is disposed on a lower side of the separator S2.

An inner space of the tank 220 is divided into two spaces by a separator (not shown). A position of the separator is lower than the separator S1 and higher than the separator S2.

Each of the tubes 230 is a tubular member through which the refrigerant flows. The evaporator 200 includes multiple tubes 230. Each of the tubes 230 is an elongated straight tube and extends in the horizontal direction. The tubes 230 have one end fluidly connected to the tank 210 and the other end fluidly connected to the tank 220. Thereby, the inner space of the tank 210 is fluidly connected to the inner space of the tank 220 through the tubes 230.

The tubes 230 are stacked in the vertical direction, that is a longitudinal direction of the tank 210 and the like. In this embodiment, the tubes 230 are arranged adjacent to the tubes 130 in the airflow direction. That is, the number of the tubes 230 is equal to the number of the tubes 130 and each of the tubes 230 is located at a position in the same height as that of each of the tubes 130.

The refrigerant flowing into the receiving portion 211 from an outside of the tank 210 flows into an upper space in the inner space of the tank 210 that is defined upper than the separator S1. The refrigerant flows through some of tubes 230 located upper than the separator S1 and flows into the inner space of the tank 220 that is defined upper than the separator (not shown). After that, the refrigerant flows through some of the tubes 230 located between the separator S1 and the separator and flows into the inner space of the tank 210 that is defined between the separator S1 and the separator S2.

After that, the refrigerant flows through some of the tubes 230 located between the separator S2 and the separator of the tank 220, and flows into the space in the inner space of the tank 220 that is defined on a lower side of the separator. The refrigerant flows through the other of the tubes 230 located in a lower side of the separator S2, flows into a lower space of the separator S2 in the inner space of the tank 220, and flows out through the discharge portion 212.

The refrigerant is heated and evaporated by the air flowing through outside of the tubes 230 and converted into the gas-phase from the liquid-phase while flowing through inside of the tubes 230. The air has an increased temperature after passing through the radiator 100. The air is deprived of its heat and cooled when flowing through outside of the tubes 230.

Figure 3:
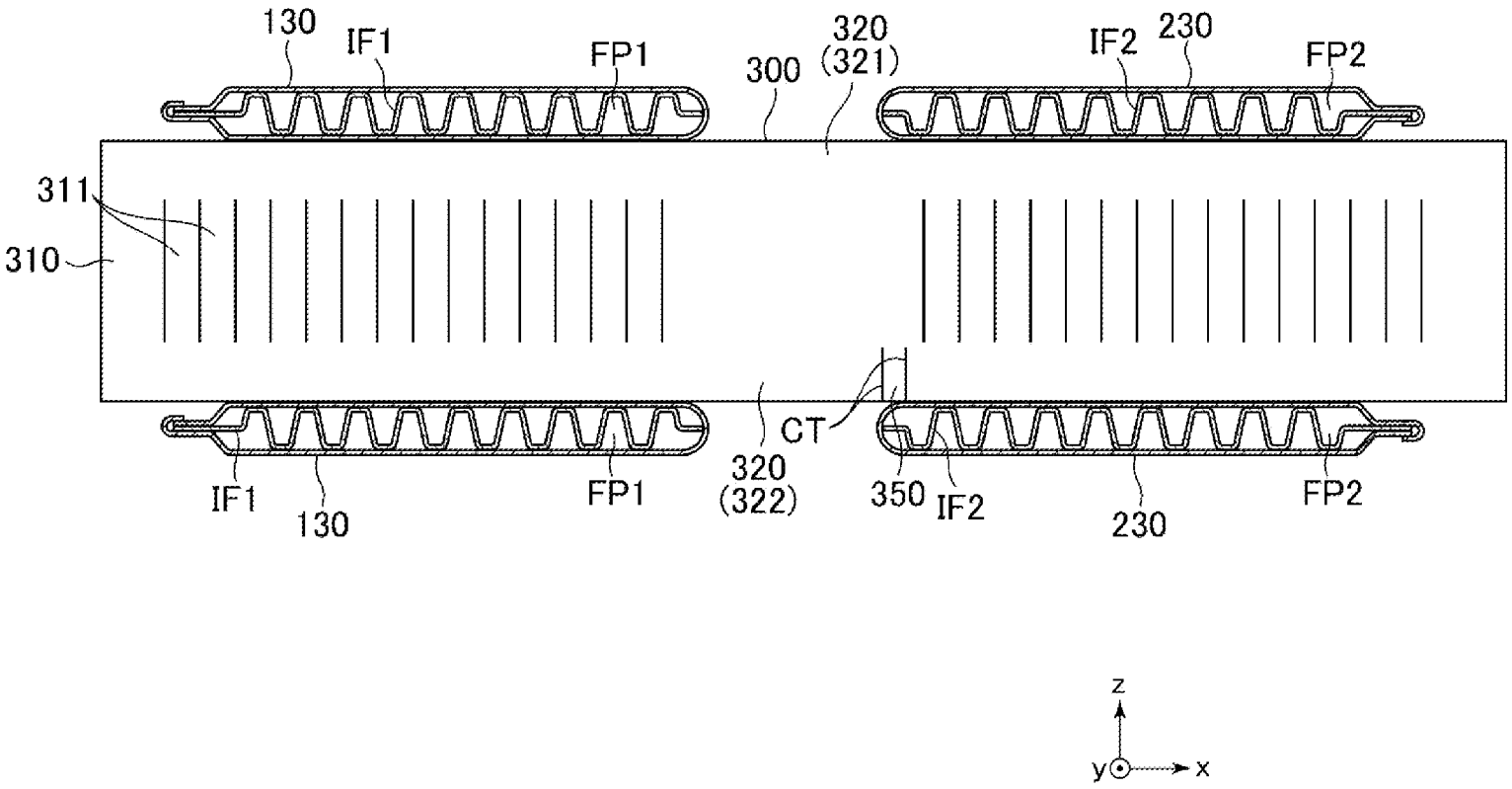
FIG. 3 is a diagram of a fin and tubes disposed an upper side and a lower side of the fin of the heat exchanger.

Each of the fins 300 (not shown in FIG. 1) is disposed between adjacent ones of the tubes 230 in the vertical direction. The fins 300 are the same as the fins 300 of the radiator 100. As shown in FIG. 3, each of the fins 300 extends from a space between the tubes 130 of the radiator 100 to a space between the tubes 230 of the evaporator 200. That is, the fins 300 are commonly used between the radiator 100 and the evaporator 200.

Thus, the fins 300 and the tubes 230 are alternately arranged in the vertical direction in the evaporator 200, similarly to a situation in the radiator 100. The peaks of the corrugated fins 300 are in contact with and brazed to the surfaces of the adjacent ones of the tubes 230 in the vertical direction.

When the refrigerant flows through the inside of the tubes 230, the heat of the air is transferred to the refrigerant through the tubes 230 and also through the tubes 230 and fins 300. That is, the fins 300 increase contact areas with the air, thereby improving a heat exchange between the air and the refrigerant.

In this embodiment, the heat of the cooling water flowing through the tubes 130 is also transferred to the refrigerant flowing through the tubes 230 by a heat transfer through the fins 300. The evaporator 200 collects the heat of the cooling water in addition to the heat of the air, thereby further improving an operational efficiency of the air conditioner.

As shown in FIG. 1, a reinforcing plate 11 is disposed on an upper side of the uppermost tube 130 and the uppermost tube 230. A reinforcing plate 12 is disposed on a lower side of the lowermost tube 130 and the lowermost tube 230. The reinforcing plates 11 and 12 are metal plate that reinforce the tubes 130 and the like and restrict the tubes 130 and the like from deforming.

In FIG. 1, a direction from the radiator 100 to the evaporator 200, that is a direction in which the air flows to pass therethrough is defined as a x direction. A x axis is defined along the x direction. A direction perpendicular to the x direction from the tank 120 to the tank 110, that is the longitudinal direction of the tubes 130 and the like is defined as a y direction. A y axis is defined along the y direction. A direction perpendicular to both the x direction and the y direction from a lower side to an upper side of the heat exchanger 10, that is the longitudinal direction of the tank 110 and the like is defined as a z direction. A z axis is defined along the z direction. Hereinafter, the x direction, y direction, and z direction defined as described above are used for the description.

The x direction is the airflow direction in which the air flows along the fins 300 and corresponds to "the width direction" of the tubes 130, 230 extending in the y axis.

The specific shape of the fins 300 will be described. FIG. 2 is a diagram illustrating one of the fins 300 located between the tubes 130 and the tubes 230. The fin 300 includes offset portions 350 which will be described later, but the illustrations thereof are omitted in FIG. 2.

As described above, the fin 300 is corrugated. As shown in FIG. 2, portions of the fin 300 are bent near the tubes 130 and the tubes 230. The portions of the fin 300 that are bent as described above are referred to as "bent portions 320".

Some of the bent portions 320 of the fin 300 located near the tube 130, 230 that is disposed on an upper side of the fin 300 are sometimes referred to as "upper bent portions 321". Similarly, the others of the bent portions 320 of the fin 300 located near the tube 130, 230 that is disposed on a lower side of the fin 300 are sometimes referred to as "lower bent portions 322".

The fin 300 has parts located between two of the bent portions 320 and substantially extending in the vertical direction. That is, the parts connect between one of the upper bent portions and one of the lower bent portions 322. The parts have substantially flat plate shape except for the louvers 311 which will be described later. The parts of the fin 300 are hereinafter referred to as "flat plate portions 310".

In this embodiment, the peaks of corrugated parts of the fin 300 have flat surfaces extending along surfaces of the tubes 130 and 230 that are adjacent to the fin 300. The flat surfaces are hereinafter referred to as "flat portions 323". Each of the flat portions 323 is located between the bent portions 320 in the y direction. In place of this, the peaks of the corrugated parts of the fin 300 may be the bent portions 320, that is, the flat portions 323 are not necessarily formed.

FIG. 3 is a cross-sectional view of the fin 300 and the tubes 130 and 230 that are disposed on both sides of the fin 300 in an up-down direction. As shown in FIG. 3, each of the tubes 130, 230 has a cross section having a flat shape extending in the x direction. Each of the tubes 130 defines therein a passage FP1 through which the cooling water flows. An inner fin IF1 is disposed in the passage FP1. Similarly, each of the tubes 230 defines therein a passage FP2 through which the refrigerant flows. An inner fin IF2 is disposed in the passage FP2.

As shown in FIG. 3, each of the flat plate portions 310 of the fin 300 has multiple louvers 311. The louvers 311 are formed by cutting and raising parts of each of the flat plate portions 310. Specifically, straight slits extending in the z direction are formed in the flat plate portions 310 such that the straight slits are arranged in the x direction. Then, parts of the flat plate portions 310 between the adjacent ones of the straight slits are twisted to form the louvers 311. There are gaps near the louvers 311 and the air flows through the gaps, thereby improving the efficiently of the heat exchange with the air. The shapes of the louvers 311 may be known one of the conventional fin.

As shown in FIGS. 3 to 7, each of the fins 300 has the offset portions 350 at parts of the fin 300. Each of the offset portion 350 is formed into a dented shape by defining a pair of straight slits CT at each of the fins 300 and having a portion of each of the fins 300 between the pair of slits CT recessed inward one of the bent portions 320. That is, the portion between the pair of slits CT are offset inward to form the offset portion 350. The shape of the pair of slits CT is not limited to a straight shape and may be a curved shape.

Figure 4:
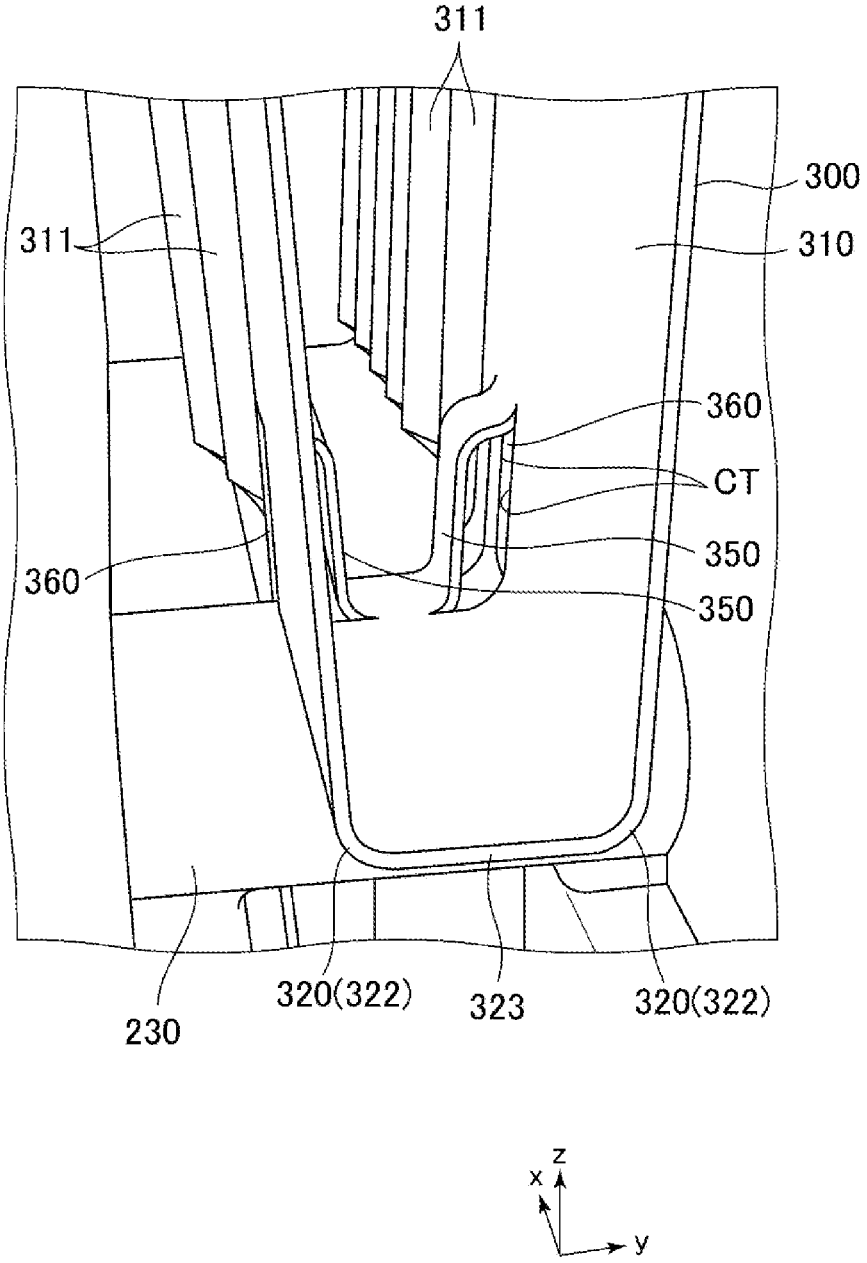
FIG. 4 is an enlarged view of a part of the fin of the heat exchanger.
Figure 5:
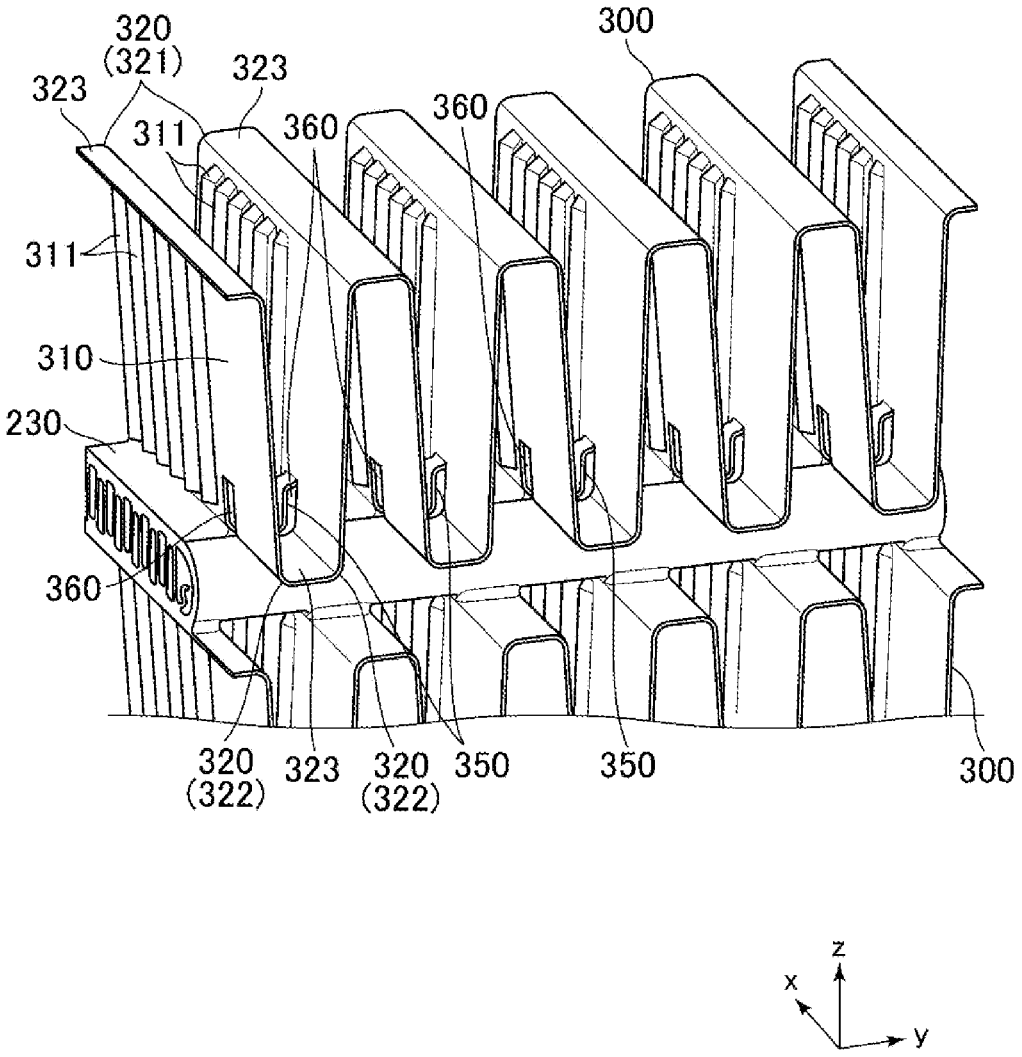
FIG. 5 is an enlarged view of a part of the fin of the heat exchanger.

Because of forming the offset portions 350 as described above, openings 360 are defined between the pair of slits CT as shown in FIGS. 4 and 5. The inner space of the lower bent portions 322 and an outer space of the lower bent portions 322 are in communication through the openings 360.

As shown in FIG. 3, each of the pair of slits CT extends in the up-down direction. The pair of slits CT are parallel to each other and located at the same height. Each of the fins 300 has the offset portions 350 near an end of the tube 230 in a−x direction.

In this embodiment, a portion of the pair of slits CT extends to one of the lower bent portions 322, but areas of the fins 300 in which the pair of slits CT are formed are not limited to this area. For example, entire portion of the pair of slits CT is formed in the lower bent portion 322. Alternatively, at least a portion of the slits CT may extend to the flat portion 323 over the lower bent portion 322. That is, "that the pair of slits CT extend to the lower bent portion 322" means not only that ends of the pair of slits CT are located in the lower bent portion 322 but also that the ends of the pair of slits CT are located in the flat portion 323 and the like over the lower bent portion 322.

Figure 6:
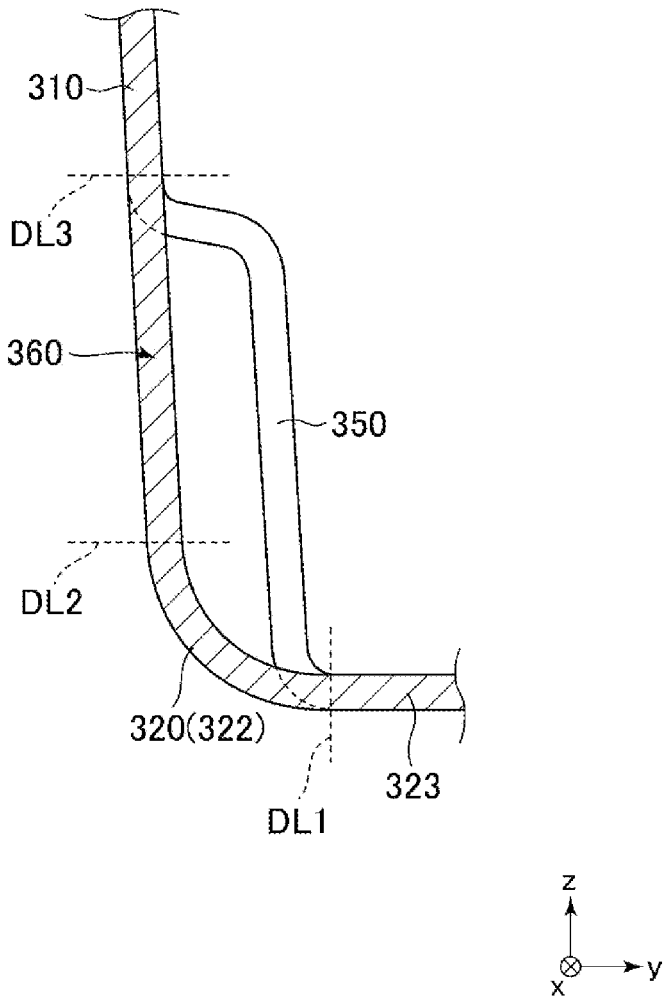
FIG. 6 is a diagram illustrating a shape of an offset portion formed in the fin.

A dotted line DL1 in FIG. 6 indicates a boundary between the lower bent portion 322 and the flat portion 323 adjacent to the lower bent portion 322. A dotted line DL2 in the same figure indicates a boundary between the lower bent portion 322 and the flat plate portion 310. A dotted line DL3 in the same figure indicates an upper end of the pair of slits CT in the z direction.

Each of the pair of slits CT of this embodiment extends from a part of the flat plate portion 310 (i.e., a part on the upper side of the dotted line DL2 in the z direction) to a lower end of the lower bent portion 322 (i.e., a position of the dotted line DL1). The offset portion 350 has a part extending to the dotted line DL1 and the part of the offset portion 350 is substantially parallel to the flat plate portion 310.

The fin 300 has a contact area that is in contact with and brazed to the tube 230. A dotted line DL11 in FIG. 7 indicates one end position of the contact area in the width direction of the tube 230. The one end is located in the −x side of the tube 230. A dotted line DL12 in the same figure indicates the other end of the contact area in the width direction. The other end is located in the x side of the tube 230. The area from the dotted line DL11 to the dotted line DL12 in the x direction is hereinafter referred to as "a contact area DM1".

Figure 7:
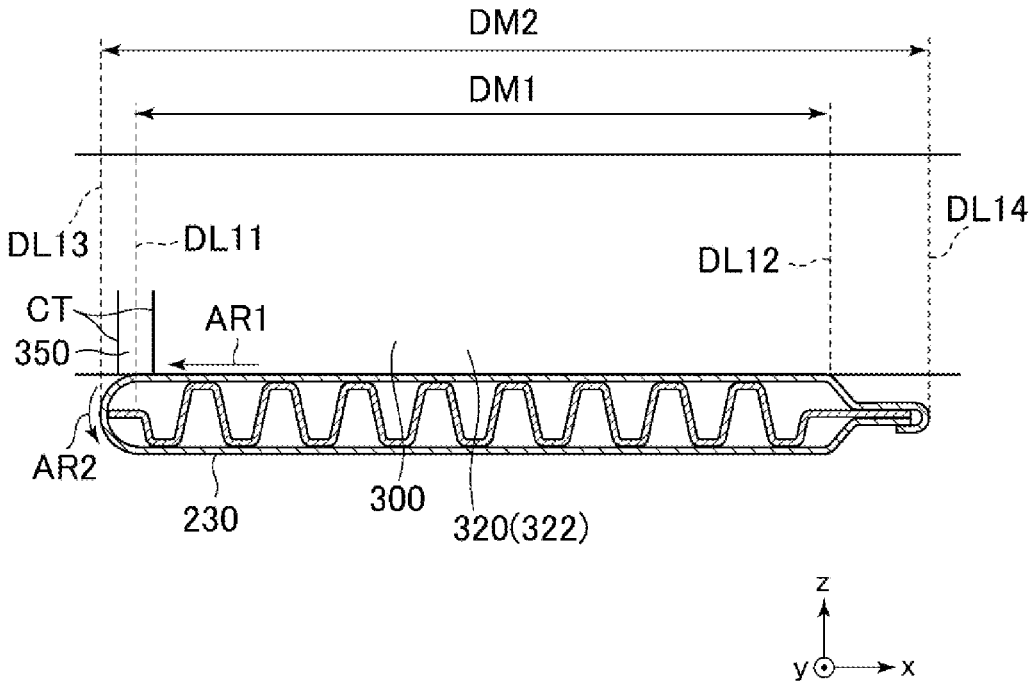
FIG. 7 is a diagram explaining a position of the offset portion.

A dotted line DL13 in FIG. 7 indicates one end of the tube 230 in the x direction. The one end is located on the −x side of the tube 230. A dotted line DL14 in the same figure indicates the other end of the tube 230 in the x direction. The other end is located on the x side of the tubes 230. An area from the dotted line DL13 to the dotted line DL14 in the x direction is hereinafter referred to as "a tube area DM2".

The offset portion 350 of this embodiment is formed within the tube area DM1. That is, the pair of the slits CT sandwiching the offset portion 350 is formed between the both ends of the tube 230 in the width direction. In other words, the pair of slits CT are located on the x side of the dotted line DL13. Further, the offset portion 350 is overlapped with the contact area DM1. That is, the offset portion 350 is formed at an overlapping position with the contact area where the tube 230 and the fin 300 are in contact with each other.

The air passing through the heat exchanger 10 contains water vapor. Thus, while the air is cooled in flowing through the outside of the tubes 230, the water vapor in the air is condensed to be condensed water and the condensed water adheres to the surfaces of the tubes 230 and the fins 300. The condensed water may frost and adhere to the surfaces of the tubes 230 and the fins 300.

The above-mentioned condensed water and water generated by melting the frost as a whole are referred to "condensed water". When the condensed water stays with adhered to the tubes 230 and the fins 300, the air is restricted from flowing through the heat exchanger 10 by the condensed water. In particular, in a configuration in which the tubes 230 are arranged to extend in the horizontal direction as with this embodiment, the condensed water is less likely to flow out with gravity. Thus, the condensed water is likely to stay as described above.

Therefore, the heat exchanger 10 of this embodiment includes the offset portion 350 to drain the condensed water. The drainage of the condensed water will be described with reference to FIG. 7.

The condensed water is likely to generate in a part of the fin 300 having a low temperature, specifically within the contact area DM1. The condensed water generated within the contact area DM1 flows outward in the x direction at a trough of the corrugated fin 300, that is the inside of the lower bent portion 322. In FIG. 7, a flow of the condensed water along the trough is shown in an arrow AR1.

The condensed water flows along the arrow AR1 and reaches the offset portion 350. Then, the condensed water flows out of the lower bent portion 322 through the opening 360 shown in FIG. 6 and the like.

As described above, the offset portion 350 is formed in the overlapping position with the contact area DM1. Thus, there is the surface of the tube 230 directly below the opening 360. The condensed water flowing out through the opening 360 comes in contact with the surface of the tube 230 directly below the opening 360 and tends to spread along the surface. In FIG. 7, the flow of the condensed water along the surface is shown in an arrow AR2.

The flow of the condensed water spreading along the surface of the tube 230 draws the flow of the condensed water in the arrow AR1, thereby promoting the flow of the condensed water in the direction of the arrow AR1. Thus, the drainage of the condensed water existing in the lower bent portion 322 through the opening 360 is assisted. In order to obtain such advantages, the offset portion 350 is preferably located at a position within the tube area DM2. Further, the offset portion 350 is preferably located in an overlapping position with the contact area DM1.

The offset portion 350 may entirely overlap with the tube area DM2, or a part of the offset portion 350 may overlap with the tube area DM2. Only a part of the offset portion 350 of this embodiment may overlap with the contact area DM1 as with this embodiment or the entire part of the offset portion 350 may overlap with the contact area DM1.

What is drained through the opening 360 is not limited to the condensed water located near the lower bent portion 322. This point will be described with reference to FIG. 8. The part given the reference numeral WT2 in FIG. 8 indicates the condensed water located inside the lower bent portion 322. The condensed water is hereinafter referred to as "condensed water WT2". The parts given the reference numeral WT1 in the same figure indicate the condensed water located in spaces opposite to the space in which the condensed water WT2 is located relative to the flat plate portions 310. The condensed water is hereinafter referred to as "condensed water WT1". The condensed water WT1 is also said to be the condensed water existing inside the peak of the corrugated fin 300. The condensed water WT1 is wet with the pair of the flat plate portions 310 adjacent to each other in the y direction and supported by the pair of the flat plate portions 310.

Figure 8:
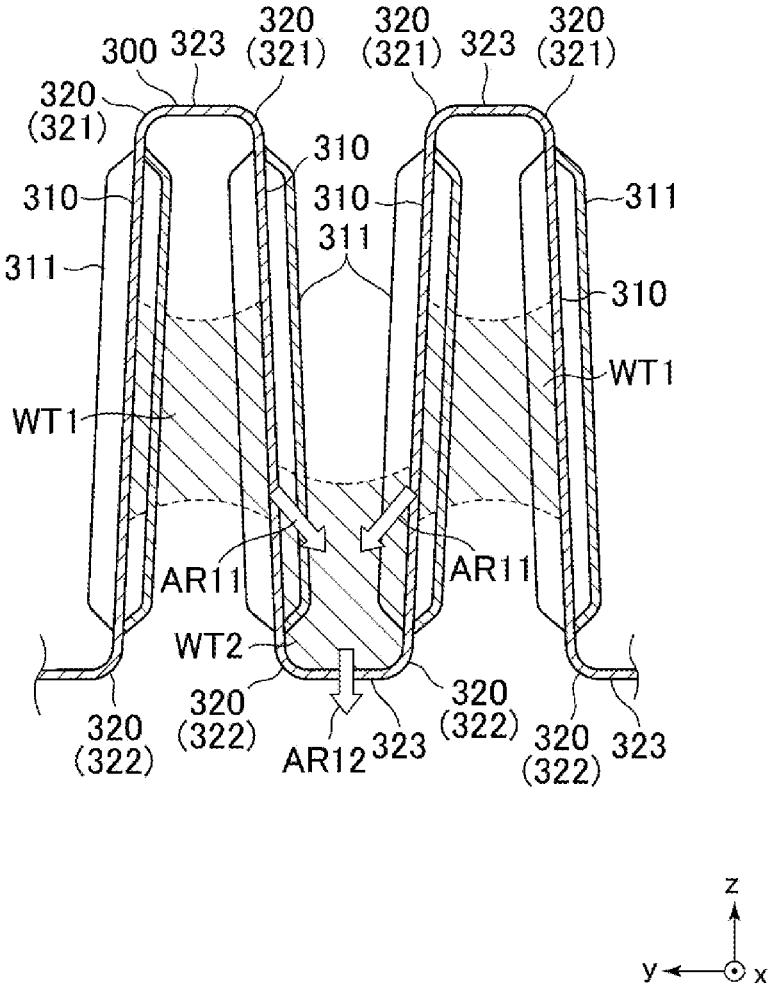
FIG. 8 is a diagram explaining a path through which condensed water is drained.

As shown in FIG. 8, the condensed water WT1 and the condensed water WT2 are in connection with each other through the space defined by the louvers 311.

The condensed water WT2 flows out of the lower bent portion 322 through the opening 360 as described above. An arrow AR12 in FIG. 8 shows a flow of the condensed water WT2 flowing out in this way.

When the condensed water WT2 flows out as described above, the condensed water in connection with the condensed water WT2 is drawn into the lower bent portion 322 through the gaps defined between the louvers 311. Arrows AR11 shown in FIG. 8 indicate a drawn flow of the condensed water WT1 in this way. Along with this flow, the amount of the condensed water WT1 shown in FIG. 8 is gradually decreased. Finally, the condensed water WT1 continuously supported between the pair of the flat plate portions 310 is divided into a part adhered to one of the flat plate portions 310 and a part adhered to the other one of the flat plate portions 310. In this state, a force to hold the condensed water WT1 is small. Thus, the condensed water WT1 flows downward with gravity and is drained outward.

As described above, the heat exchanger 10 of this embodiment includes the offset portions 350 at the fins 300 to define the opening 360. As a result, the drainage of the condensed water stayed in the fin 300 is enhanced.

It is also considered to define a through hole by removing a part of the fin 300 in place of forming the offset portion 350 as described above in order to define an opening for the drainage. In this case, it is necessary to form the fin 300 while discharging the part of the fin 300 to be the through hole.

However, it is difficult to discharge the removed part in a conventional way in which a metal plate is pressed between a pair of rollers to form a fin. Thus, in case of forming the through hole at the fin 300, the conventional way cannot be used.

In contrast, the fin 300 in this embodiment defines the opening 360 by forming the pair of slits CT at a metal plate that is a material of the fin 300 and deforming a part of the fin 300 between the pair of slits CT. The opening 360 is defined without discharging the material, so that the fin 300 can be formed in the conventional way using the rollers as described above.

In this embodiment, the opening 360 is defined without removing a part of the material of the fin 300. Thus, a heat transfer area of the fin 300 is not reduced, thereby obtaining advantages to restrict the heat-exchange property from reducing.

As shown in FIG. 5, the pairs of slits CT and the offset portions 350 are formed near the lower bent portions 322 but not formed near the upper bent portions 321. By limiting the positions of the offset portions 350 in a minimum range required for the drainage of the condensed water, the thermal resistance of the fin 300, which is increased by forming the offset portions 350 and the like, is restricted from increasing.

When the increase in the thermal resistance is not a big issue, the pairs of slits CT and the offset portions 350 may be formed both near the lower bent portions 322 and near the upper bent portions 321. In this configuration, the fin 300 has a vertically symmetrical shape, so that it is not necessary to distinguish an up and down of the fin 300 in manufacturing step.

A second embodiment will be described with reference to FIG. 9. In this embodiment, the second embodiment is different from the first embodiment at the shape of the offset portion 350 formed in the fin 300. Other portions of the second embodiment are similar to those of the first embodiment.

A dotted line DL21 indicates an end of the offset portion 350 in the y direction. As shown in the same figure, a part of the offset portion 350 enters further into the lower bent portion 322 over the lower end of the pair of slits CT, compared to the first embodiment in FIG. 6. That is, the part of the offset portion 350 enters in the y direction over the dotted line DL1. As a result, a gap in the y direction between the offset portion 350 and the flat plate portion 310 increases in a direction from the lower end to the upper end.

Figure 9:
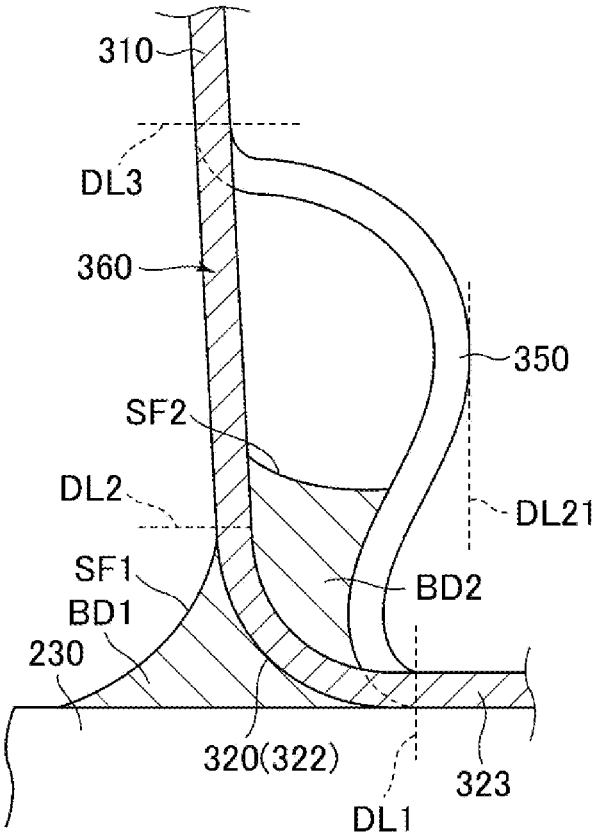
FIG. 9 is a diagram explaining a shape of an offset portion formed in a fin of a heat exchanger of a second embodiment.
Figure 9:
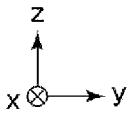

As shown in FIG. 9, there is a brazing material BD1 between the fin 300 and the tube 230 located on a lower side of the fin 300 to braze therebetween. The brazing material BD1 has a surface SF1. The surface SF1 is curved and recessed due to a surface tension of a liquid phase of the melting brazing material BD1 in brazing.

In brazing, a part of the brazing material may enter into the gap between the offset portion 350 and the flat plate portion 310 and be drawn upward due to capillary action. A brazing material BD2 shown in FIG. 9 indicates a brazing material having been drawn up and solidified. The brazing material BD2 also has a surface SF2 that is recessed and curved due to a surface tension of the melting liquid phase of the brazing material BD2 in brazing.

If the brazing material is drawn up to the upper end of the offset portion 350, the opening 360 is filled with the brazing material BD2. Thus, the condensed water cannot be drained through the opening 360. However, in this embodiment, the gap between the offset portion 350 and the flat plate portion 310 is increased to prevent such situation.

In brazing, the brazing material BD1 and the brazing material BD2 are connected with each other. In this state, the surface SF2 has the radius of curvature that is equal to the radius of curvature of the surface SF1. In other words, the radius of curvature of the surface SF2 cannot be greater than the radius of curvature of the surface SF1.

As described above, the gap between the offset portion 350 and the flat plate portion 310 is increased in an upward direction. Thus, when the melting brazing material BD2 is drawn upward to a position upper than the position shown in FIG. 9, the width of the brazing material BD2 is increased. Thus, the radius of curvature of the surface SF2 should be increased along with this. However, the radius of curvature of the surface SF2 cannot be greater than the radius of curvature of the surface SF1 as described above. Accordingly, upward movement of the brazing material BD2 is stopped at a position where the radius of curvature of the surface SF2 is the same with the radius of curvature of the surface SF1. Thereby, the opening 360 is restricted from being filled with the brazing material BD2. Also in this configuration, the same advantages described in the first embodiment can be obtained.

A third embodiment will be described with reference to FIG. 10. The third embodiment is different from the first embodiment in the shape of the offset portion 350 formed in the fin 300. Other portions of the third embodiment are similar to those of the first embodiment.

Figure 10:
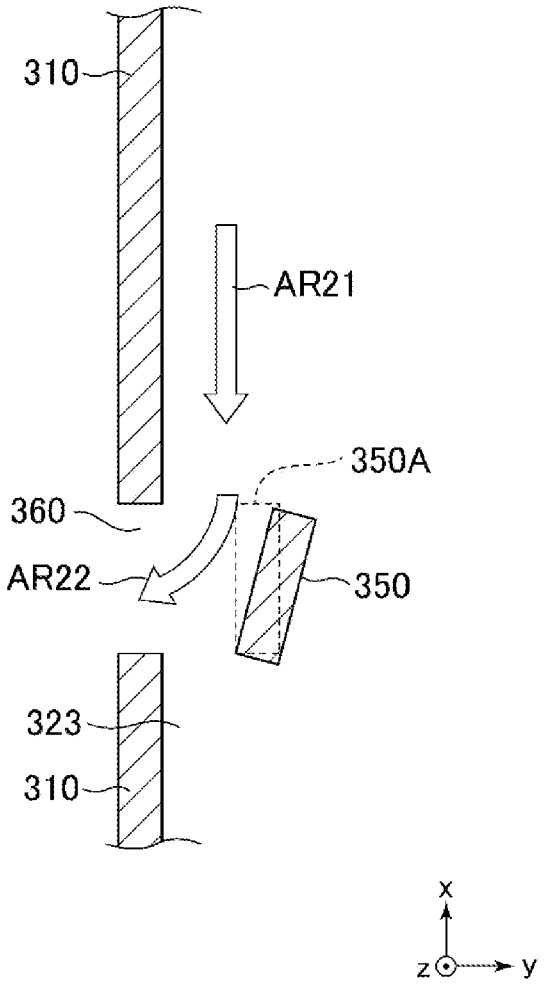
FIG. 10 is a diagram explaining a shape of an offset portion formed of a fin of a heat exchanger of a third embodiment.

FIG. 10 is a schematic cross-sectional view of a part of the fin 300 including the offset portion 350. The cross-sectional view is taken along a surface perpendicular to the z axis. A dotted line 350A indicates a cross-sectional of the offset portion 350 when the shape of the fin 300 is the same as that of the first embodiment.

In this embodiment, the offset portion 350 is twisted around the z axis. As a result, the offset portion 350 is tilted relative to the width direction of the fin 300 (i.e., the x direction). Specifically, the offset portion 350 is tilted such that the offset portion 350 is located closer to the flat plate portion 310 located on the −y side of the offset portion 350 in a direction to the −x side of the offset portion 350.

An arrow AR21 in FIG. 10 shows the flow of the condensed water that is generated in the contact area and flows in the width direction along the trough of the fin 300 to the −x side of the heat exchanger 10. The condensed water flowing as such changes its flow direction by reflecting at the tilted offset portion 350 and flows toward the opening 360 as shown in an arrow AR22. That is, the condensed water is guided toward the opening 360 by the tilted offset portion 350 and drained through the opening 360.

The offset portion 350 of this embodiment is tilted relative to the width direction of the fin 300, i.e., the x direction in order to guide the water flowing through the lower bent portion 322 in the width direction to the opening 360 defined between the pair of slits CT. Thus, the drainage of the condensed water is further assisted. Also in this embodiment, the similar advantages described in the first embodiment can be obtained.

The part of the offset portion 350 of this embodiment enters further into the lower bent portion 322 compared to that of the first embodiment shown in the dotted line 350A. Thus, the similar advantages as those obtained in the second embodiment that are described with reference to FIG. 9 can be obtained.

A fourth embodiment will be described with reference to FIG. 11. This embodiment is different from the first embodiment in the position of the offset portion 350.

Figure 11:
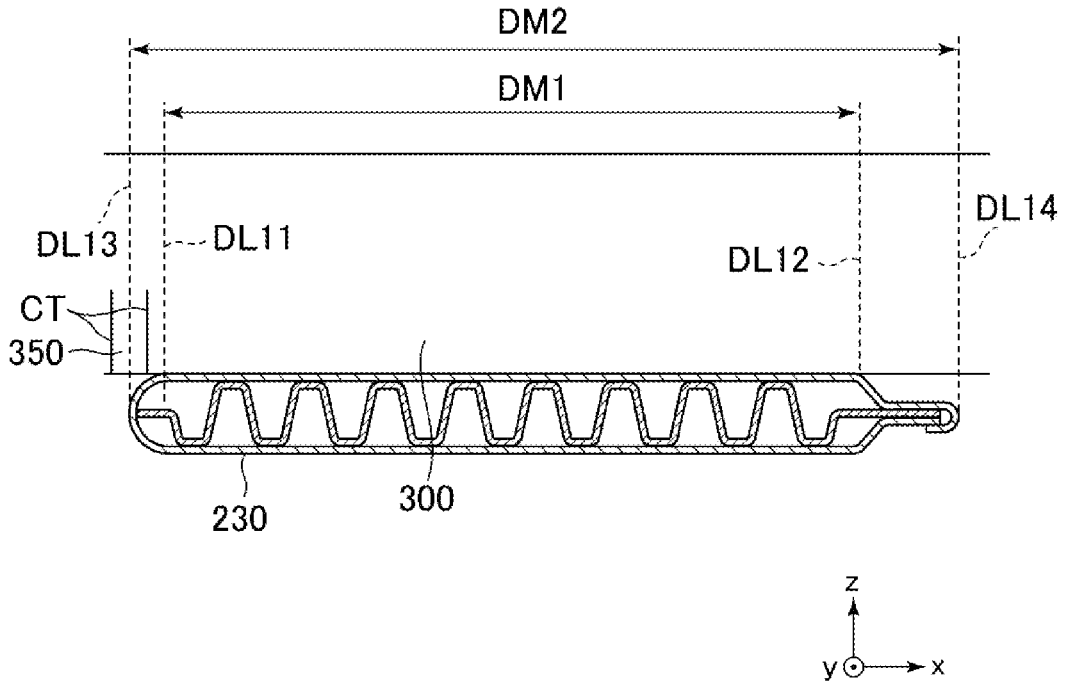
FIG. 11 is a diagram explaining a position of the offset portion of a heat exchanger of a fourth embodiment.

As shown in FIG. 11, in this embodiment, one of the pair of slits CT defining the offset portion 350 therebetween is located in an outside of the tube area DM2. That is, the one of the pair of slits CT is located on the −x side of the dotted line DL13. The other one of the pair of slits CT is located inside of the tube area DM2. That is, the other one of the pair of slits CT is located on the x side of the dotted line DL13. As a result, the offset portion 350 located between the pair of slits CT has only a portion that is overlapped with the tube area DM2.

As described above, only one of the pair of slits CT defining the offset portion 350 therebetween may be located inward of the end of the tube 230 in the width direction. Also in this configuration, the same advantages that the drainage of the condensed water through the opening 360 is assisted can be obtained.

In FIG. 11, the one of the pair of slits CT located on the x side of the fin 300 may be located on the x side of the dotted line DL11. That is, the offset portion 350 may be located in the overlapping position with the contact area DM1 as with in the first embodiment.

Figure 12:
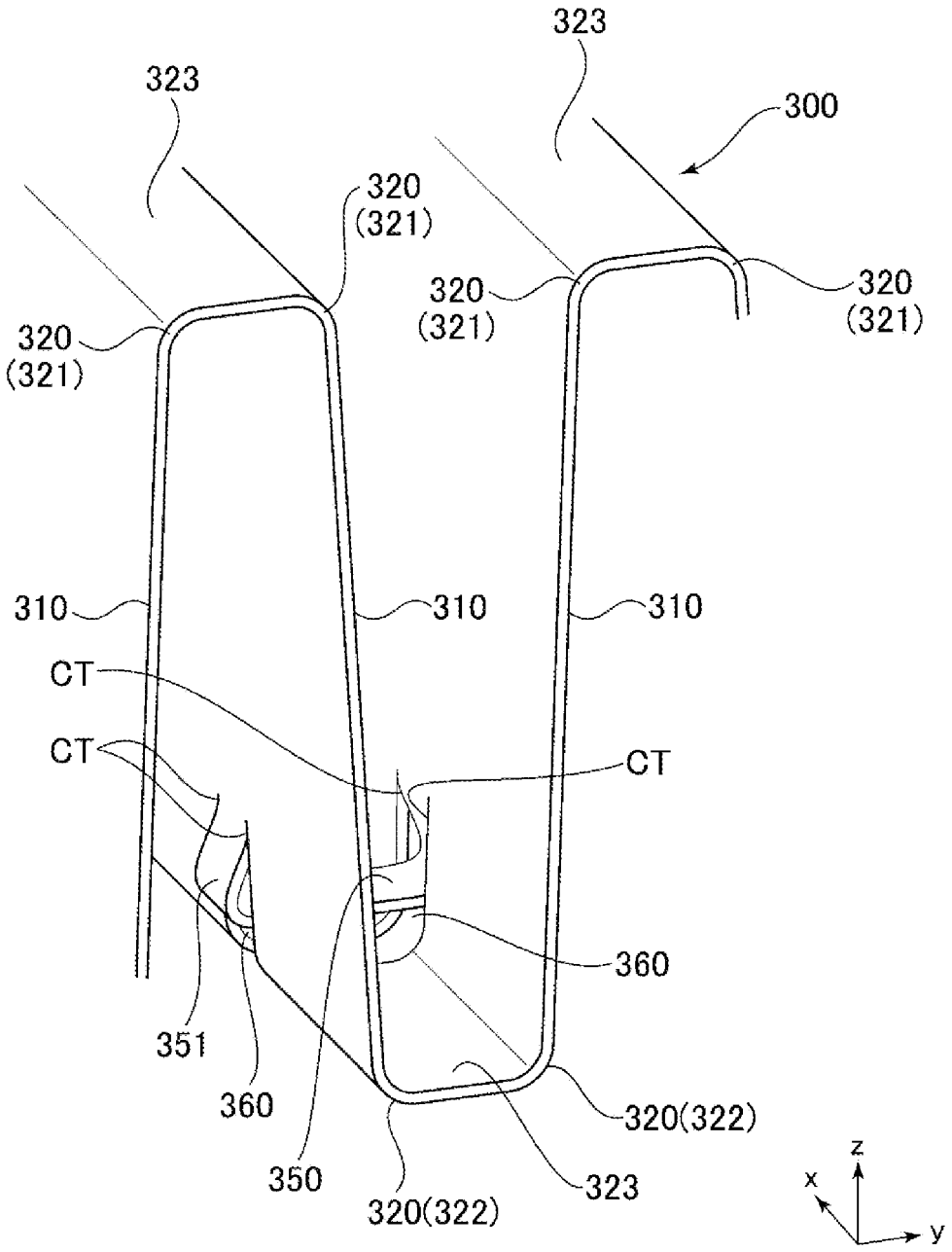
FIG. 12 is an enlarged view of a part of a fin of a heat exchanger of a fifth embodiment.
Figure 13:
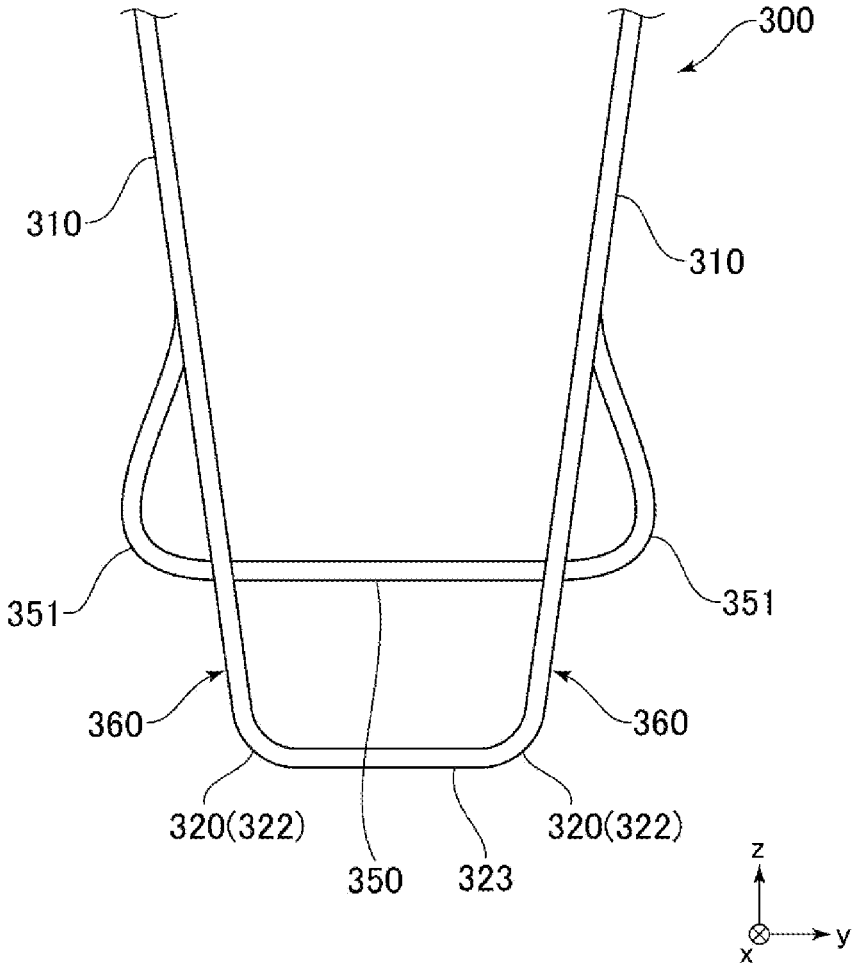
FIG. 13 is an enlarged view of a part of the fin of the heat exchanger of the fifth embodiment.

A fifth embodiment will be described with reference to FIGS. 12 and 13. FIG. 12 is a schematic enlarged view of the offset portion 350 and its peripheral portion of the fin 300 of this embodiment. FIG. 13 is a schematic view of the above-described portion of the fin 300 viewed in the x direction. In FIGS. 12 and 13, illustrations of the louvers 311 are omitted.

In this embodiment, both of the pair of slits extend from the flat plate portion 310 on the −y side to the adjacent flat plate portion 310 on the y side through the lower bent portions 322 and the flat portion 323. The offset portion 350 of this embodiment is formed by forming the pair of slits CT and having a portion between the pair of slits CT deformed such that the flat portion 323 between the pair of slits CT moves in the z direction. That is, in this embodiment, the offset portion 350 is formed by having the portion between the pair of slits CT recessed into the bent portions 320, so that the offset portion 350 is recessed from the bent portions 320.

Because of the deformation described above, the portions between the pair of slits CT has parts protruding outward from the flat plate portions 310. In FIGS. 12 and 13, the parts protruding as described above are given a reference numeral 351.

In this embodiment, the pair of slits CT extend over the flat plate portions 310 and the bent portions 320 located between the flat plate portions 310. In this configuration, the opening 360 is large at the trough where the condensed water is likely to stay, so that the advantage that the condensed water is further assisted to be drain through the opening 360 in addition to the advantages described in the first embodiment are obtained.

Figure 14:
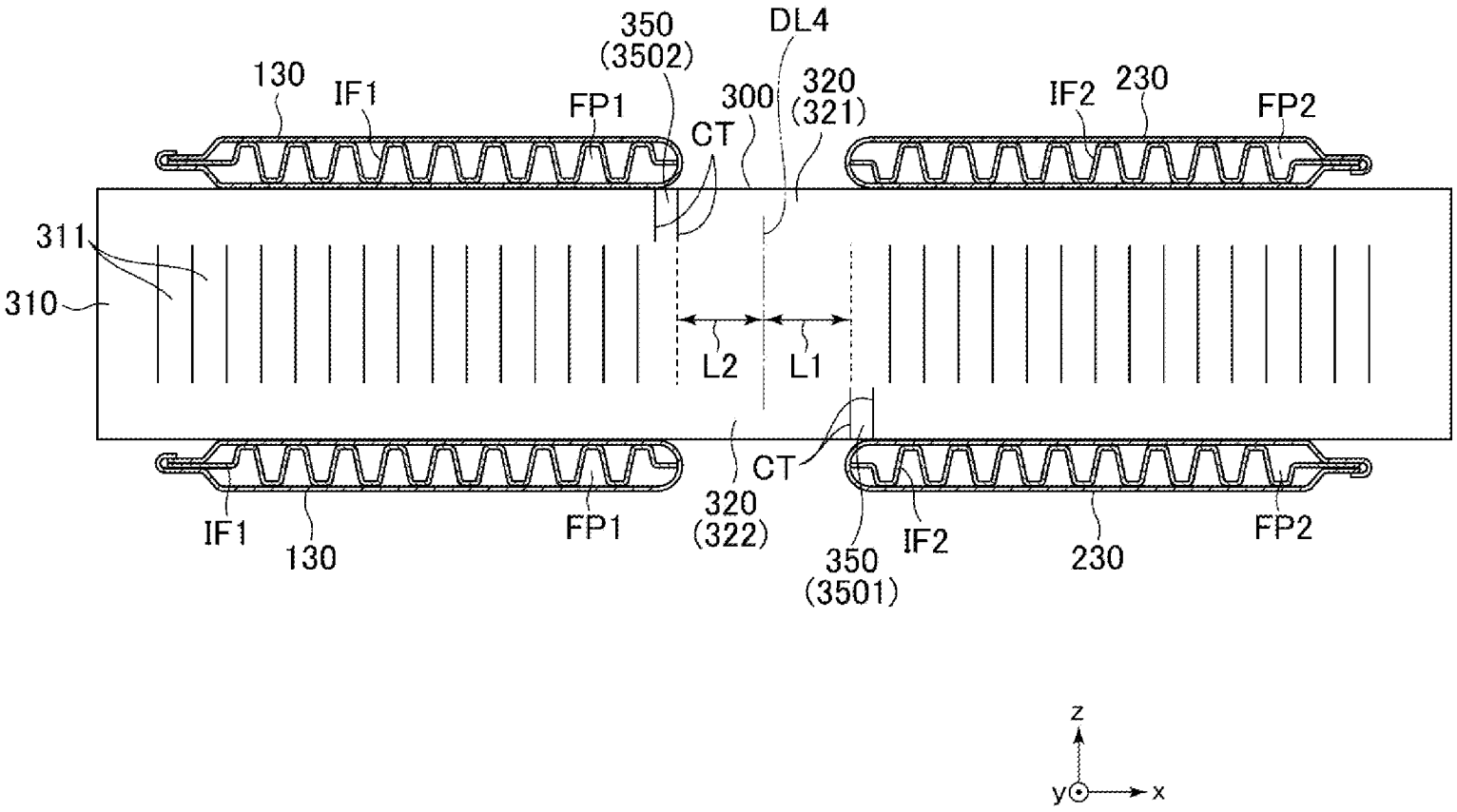
FIG. 14 is a diagram illustrating a fin and tubes located in an upper side and a lower side of the fin of a heat exchanger of a sixth embodiment.

A six embodiment will be described with reference to FIG. 14. FIG. 14 is a cross-sectional view of the fin 300 of this embodiment and the tubes 130 and 230 located on both sides of the fin 300 in the same viewpoint in FIG. 3. In this embodiment, the number and the position of the offset portions 350 are different from those in the first embodiment.

In this embodiment, one fin 300 has two offset portions 350. One of the two offset portions 350 is referred to as "a first offset portion 3501". The other one of the two offset portions 350 is referred to as "a second offset portion 3502".

As shown in FIG. 14, the first offset portion 3501 and the pair of slits CT to define the first offset portion 3501 are located near the lower bent portion 322. The position and the shape of the first offset portion 3501 is the same with those of the offset portion 350 of the first embodiment shown in FIG. 3.

The second offset portion 3502 and the pair of slits CT to define the second offset portion 3502 are located near the upper bent portion 321. The shape of the second offset portion 3502 is symmetrical to the shape of the first offset portion 3501 in the up-down direction.

As described above, the heat exchanger 10 of this embodiment includes two pairs of slits CT and the offset portions 350 both near the lower bent portion 322 and the upper bent portion 321.

A dotted chain line DL4 shown in FIG. 14 is a line extending along a center of the fin 300 in the longitudinal direction (i.e., a center of the fin 300 in the x direction). The first offset portion 3501 and the second offset portion 3502 are located respectively on both sides of the dotted chain line DL4 in the longitudinal direction. Specifically, the first offset portion 3501 is located on the x side of the dotted chain line DL4 and the second offset portion 3502 is located on the −x side of the dotted chain line DL4.

In FIG. 14, a distance between the dotted chain line DL4 that is a center position and the first offset portion 3501 is defined as a distance L1. Similarly, a distance between the dotted chain line DL4 that is the center position and the second offset portion 3502 is defined as a distance L2. In this embodiment, the distance L1 is equal to the distance L2. As a result, the first offset portion 3501 and the second offset portion 3502 are located in the diagonal line of the fin 300.

The condensed water is likely to stay near the lower bent portion 322 because of gravity. Thus, the condensed water is drained through the first offset portion 3501 located near the lower bent portion 322, while the condensed water is merely drained through the second offset portion 3502 located near the upper bent portion 321. As described above, the second offset portion 3502 has little contribution to drain the condensed water. However, this embodiment has the following advantages by including the second offset portion 3502.

When manufacturing the heat exchanger 10, the fin 300 may be erroneously arranged in a different manner in FIG. 14 in arranging the fin 300 and the tubes 130 and 230 before brazing. For example, it may be occur that the fin 300 is erroneously arranged such that the fin 300 is placed inside out, specifically the fin 300 in FIG. 14 is rotated by 180 degrees around the y axis. When such erroneous arrangement is made in the first embodiment, the offset portion 350 and the opening 360 do not exist in the lower part of the fin 300. Thus, the condensed water cannot be drained from the fin 300.

In contrast, in this embodiment, a state shown in FIG. 14 is kept even if the fin 300 is rotated around the y axis by 180 degrees. In this case, the first offset portion 3501 is located in the upper part of the fin 300 and the second offset portion 3502 is located in the lower part of the fin 300, so that the condensed water can be drained through the second offset portion 3502 located in the lower part.

The condensed water is generated near the tube 230 that has a low temperature. Thus, the offset portion 350 and the opening 360 to drain the condensed water is preferably located near the tube 230 as shown in FIGS. 3 and 14.

As described above, in this embodiment, the fin 300 is divided into two sections by the center in the longitudinal direction. The first offset portion 3501 is located in one of the two sections and the second offset portion 3502 is located in the other of the two sections. Thus, even if the fin 300 is arranged such that the fin 300 is rotated by 180 degrees around the y axis, the second offset portion 3502 is located in the lower part near the tube 230.

Further, as described above, the distance L1 is equal to the distance L2. As a result, even if the fin 300 is rotated by 180 degrees around the y axis and arranged in this state, the position of the first offset portion 3501 and the position of the second offset portion 3502 of the fin 300 are identical to those of the second offset portion 3502 and the first offset portion 3501 in FIG. 14. Thus, the drainage property for the condensed water of the fin 300 does not change by the position of the fin 300.

Figure 15:
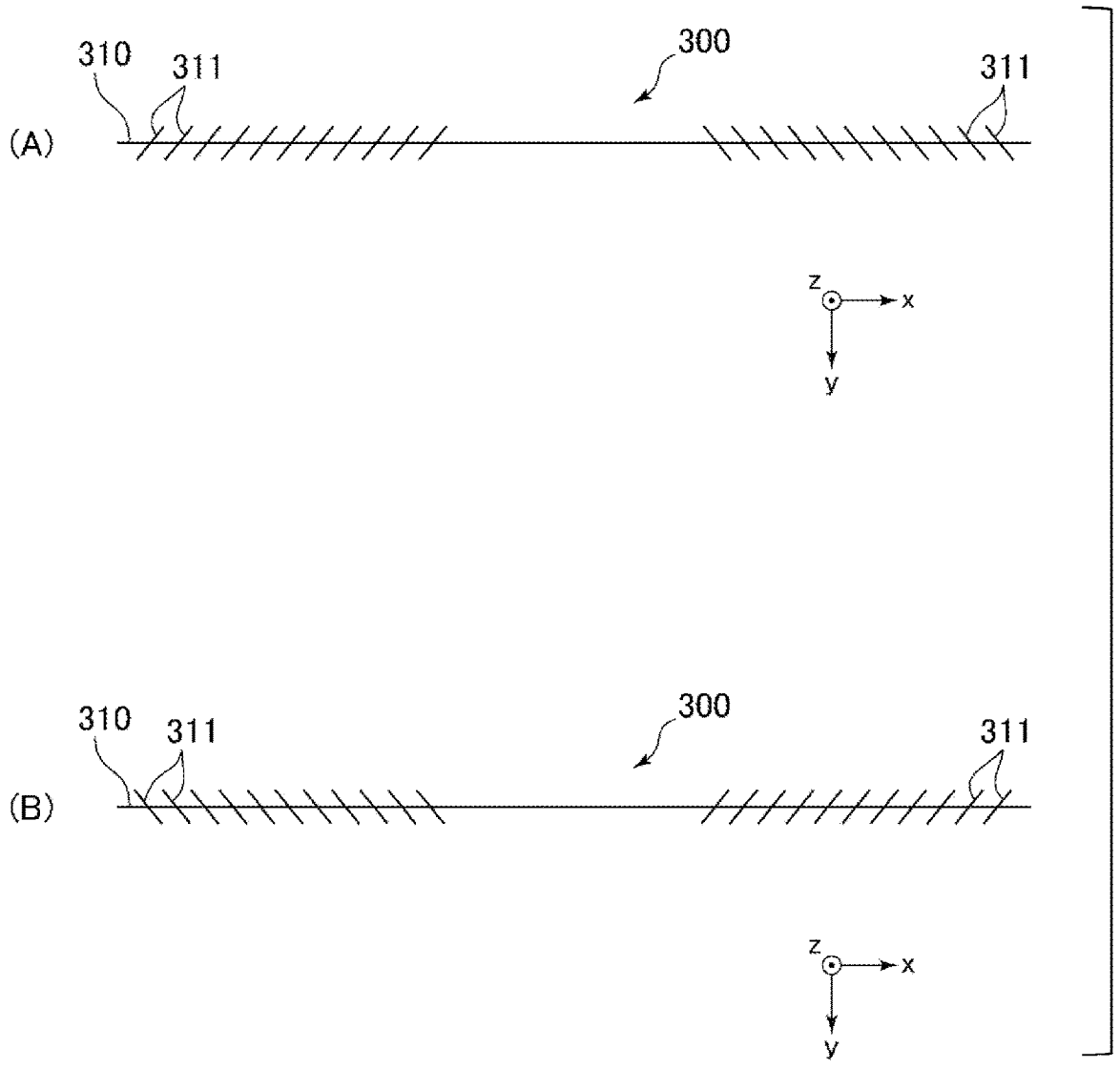
FIG. 15 is a schematic view of a configuration of the fin of the heat exchanger of the sixth embodiment.

FIG. 15(A) is a schematic view of a part of the fin 300 in FIG. 14, specifically, one flat plate portion 310 viewed in the z direction. In the schematic view, the positions of the louvers 311 in the flat plate portion 310 are illustrated. The number and the size of the louvers 311 in this figure can be different from the actual ones. The illustrations of the first offset portion 3501 and the second offset portion 3502 are omitted in FIG. 15(A).

As shown in FIG. 15(A), in a part of the flat plate portion 310 located on the −x side of the center of the flat plate portion 310, the louvers 311 are formed such that a part of the air flowing in the x direction flows through the louvers 311 from the y side to the −y side of the louvers 311. In a part of the flat plate portion 310 located on the x side of the center, the louvers 311 are formed such that a part of the air flowing in the x direction flows through the louvers 311 from the −y side to the y side of the louvers 311. The shape of the louvers 311 are equal to each other in all of the flat plate portions 310 of the fins 300.

As is clear from FIG. 15(A), even if the fin 300 is rotated by 180 degrees around the y axis, directions of the louvers 311 are the same with the original arrangement. That is, in this embodiment, even if the fin 300 is erroneously arranged as described above, the positions of the first offset portion 3501, the second offset portion 3502, and the louvers 311 are not changed. Thus, an operator can manufacture the heat exchanger 10 without distinguishing the inside and outside of the fin 300.

Even if the fin 300 is rotated by 180 degrees around the x axis or the z axis from the state in FIG. 14, either one of the offset portions 350 is located in the lower part but the arrangement of the louvers 311 is different from the original arrangement shown in FIG. 15(A). FIG. 15(B) is a schematic view illustrating the position of the louvers 311 formed in the flat plate portion 310 if the fin 300 is erroneously arranged as described above.

However, if the fin 300 is erroneously arranged as described above, the operator can notice the erroneous arrangement of the fin 300 by visually recognizing the directions of the louvers 311 of the fin 300 from the outside of the fin 300. Thereby, it is possible to prevent from proceeding to the next brazing step in a state where the fin 300 is misplaced.

The configuration including the offset portion 350 as described above, that is the configuration in which the first offset portion 3501 and the second offset portion 3502 are arranged as shown in FIG. 14, can be applied to other embodiments in the preceding embodiments.

A seventh embodiment will be described. This embodiment is different from the first embodiment in the position of the offset portion 350.

Figure 16:
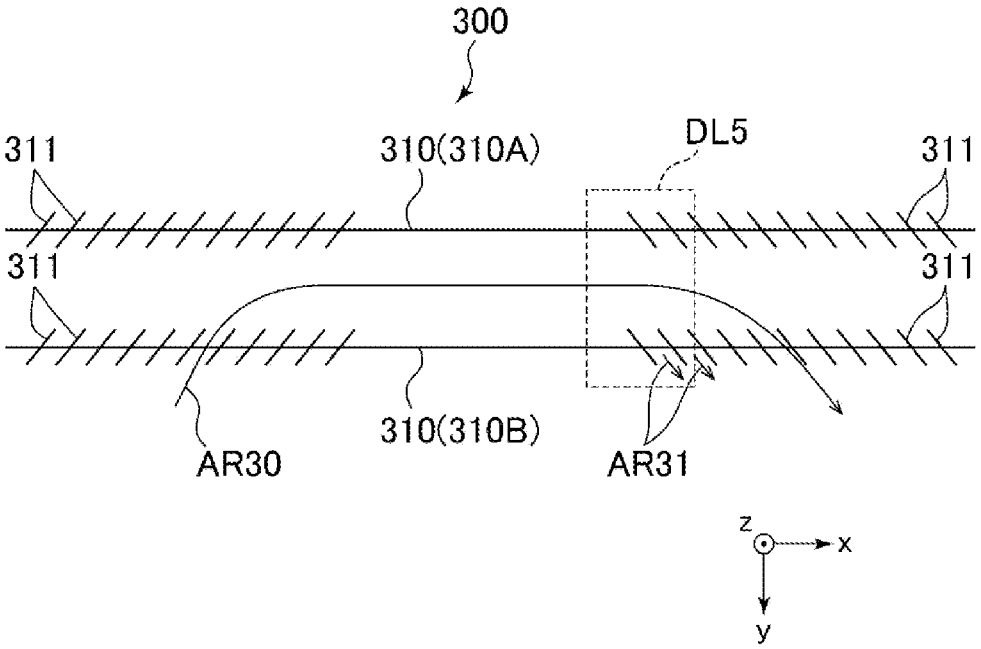
FIG. 16 is a diagram explaining an airflow in a heat exchanger of a seventh embodiment.

With reference to FIG. 16, the airflow flowing through the fin 300 will be described. FIG. 16 is a schematic view of two flat plate portions 310 adjacent to each other in the y direction of the multiple flat plate portions 310 of the fin 300. The schematic view is viewed in the z direction. In the same figure, the positions of the louvers 311 are schematically illustrated as with in FIG. 15(A). The illustration of the offset portion 350 is omitted.

In this embodiment, in a part of the flat plate portions 310 located on the −x side of the center, a part of the air flowing in the x direction flows through the louvers 311 from the y side to the −y side of the louvers 311. In a part of the flat plate portion 310 located on the x side of the center, the louvers 311 are formed such that a part of the air flowing in the x direction flows through the louvers 311 from the −y side to the y side of the louvers 311.

In FIG. 16, the airflow direction flowing along the fin 300 is shown in an arrow AR30. In the part of the flat plate portion 310 located on the −x side of the center, the air flows toward the −y side of the louvers 311 through the louvers 311 and enters into a space between the adjacent flat plate portions 310 shown in FIG. 16. The air flows to the x side of the center of the flat plate portion 310 and flows out of the space between the flat plate portions 310 through the louvers 311 shown in FIG. 16. As described above, in this embodiment, the air flows through the louvers 311 multiple times, thereby efficiently heat transferring between the air and the fin 300.

The flat plate portions 310 do not include the louvers 311 in the center in the longitudinal direction of the fin 300. Thus, the airflow direction is substantially parallel to the x axis when the air flows in the center. After that, the air is likely to flow straight due to inertia when flowing near the louvers 311 located on the downstream side of the center. Thus, the air is less likely to flow into the louvers 311. In particular, an amount of air tends to be small in a portion surrounded by a dotted line DL5 in FIG. 16 as shown in an arrow AR31.

In order to efficiently perform the heat transfer between the air and the fin 300, the air preferably passes through all of the louvers 311 formed in the flat plate portion 310 as evenly as possible. Therefore, in this embodiment, the airflow shown in the arrow AR31 in FIG. 16 is assisted by devising the position of the offset portion 350.

Figure 17:
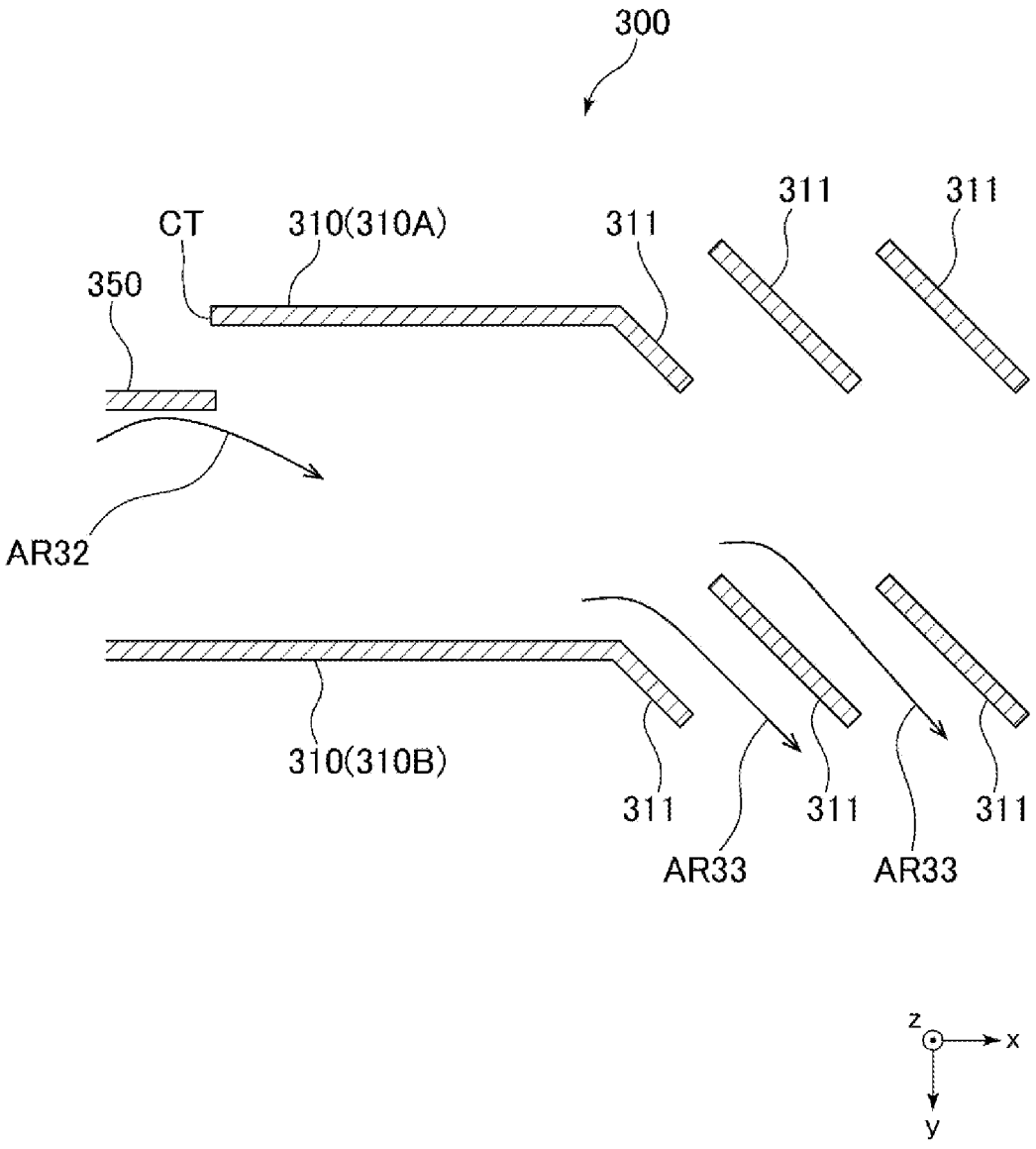
FIG. 17 is a diagram explaining the airflow in the heat exchanger of the seventh embodiment.

FIG. 17 is an enlarged view of the portion surrounded by the dotted chain line DL5 in FIG. 16. One of the two flat plate portions 310 shown in FIG. 17 located on the −y side is referred to as "a flat plate portion 310A". The other one of the two flat plate portions 310 shown in FIG. 17 located on the y side is referred to as "a flat plate portion 310B". The lower bent portions 322 (not shown) exist between the flat plate portion 310A and the flat plate portion 310B on a far side of a plane of paper in FIG. 17.

In this embodiment, only the flat plate portion 310A includes the offset portion 350 and the flat plate portion 310B does not include the offset portion 350. The offset portion 350 is formed by having a portion of the flat plate portion 310A between the pair of slits CT recessed into the lower bent portion 322, that is, toward the flat plate portion 3106.

In other words, the louvers 311 are formed in the flat plate portion 310 at a position downstream of the offset portion 350 and open in an opening direction. The offset portion 350 is formed by having the portion of the flat plate portion 310 between the pair of slits CT recessed in the opening direction, i.e., in the y direction.

The air flowing between the flat plate portion 310A and the flat plate portion 3106 flows as shown in an arrow AR30 in FIG. 16 and a part of the air reflects at a part of the offset portion 350 located on the y side of the offset portion 350. Thus, the part of the air is reflected by the offset portion 350 and changes its flow direction in the y direction. In FIG. 17, such airflow is shown in an arrow AR32.

As a result, the part of the air reflecting at the offset portion 350 changes its direction as described above and flows toward the louver 311 of the flat plate portion 3106 that is located on the most−x side of the louvers 311 located in the downstream side of the offset portion 350. As a result, the amount of the air passing through the louver 311 is increased compared to a case without the offset portion 350. In FIG. 17, the airflow direction passing through the louver 311 is shown in an arrow AR33. The airflow direction shown in the arrow AR33 corresponds to the airflow direction shown in the arrow AR31 in FIG. 16.

Figure 18:
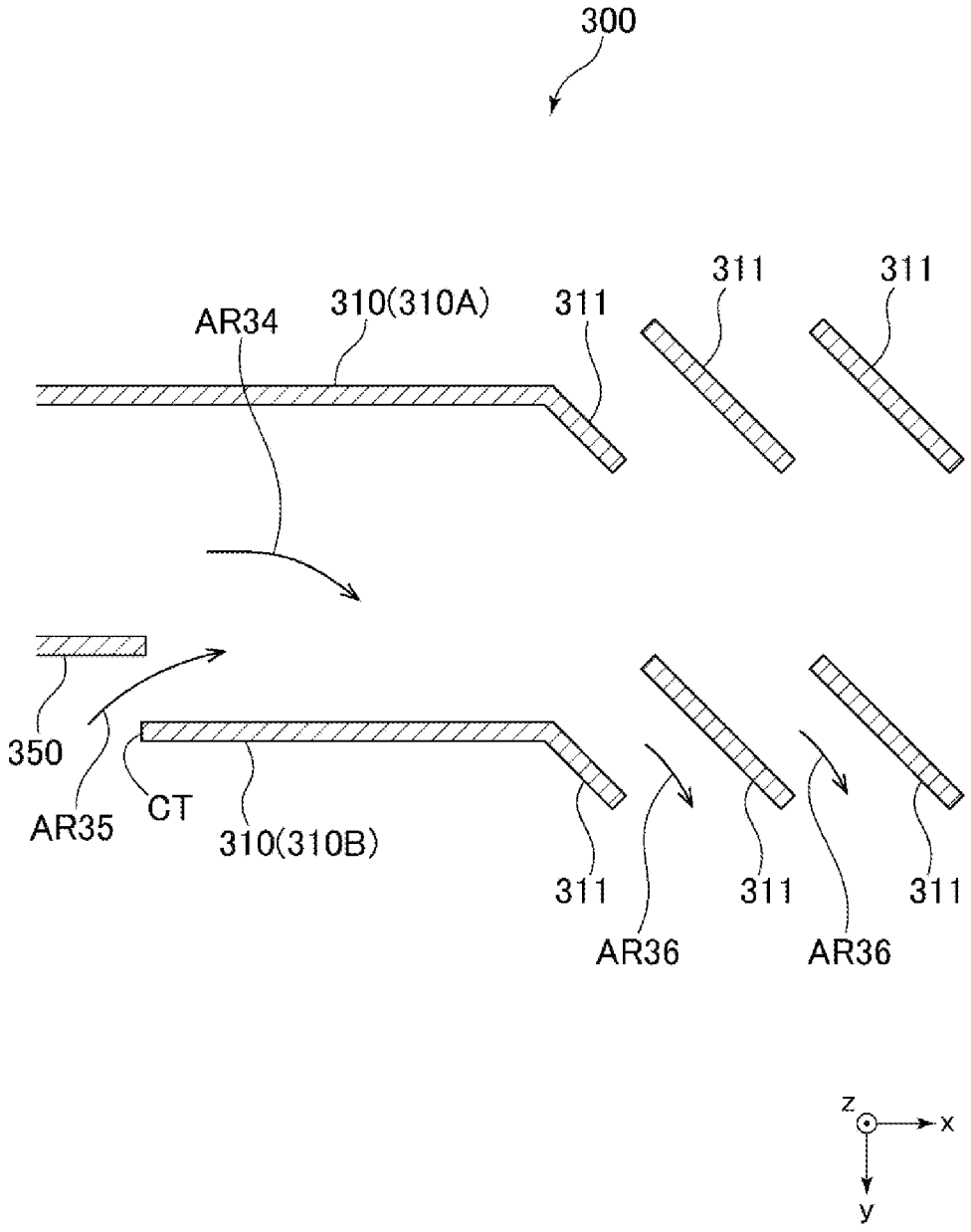
FIG. 18 is a diagram explaining an airflow in a heat exchanger of a comparative example for the seventh embodiment.

In FIG. 18, a comparative example of the present disclosure is shown. In this comparative example, contrary to the above, the offset portion 350 is formed only in the flat plate portion 3106 and not in the flat plate portion 310A. The offset portion 350 is formed by having a portion of the flat plate portion 3106 between the pair of slits CT recessed into the lower bent portion 322 (i.e., toward the flat plate portion 310A).

In such configuration, the air flows into the space between the flat plate portion 310A and the flat plate portion 3106 through the opening 360 of the offset portion 350. Such airflow direction is shown in an arrow AR35 in FIG. 18. After the air flows into the space through the offset portion 350 as described above, the air flows in the −y direction.

In FIG. 18, the airflow direction of the air in the space between the flat plate portion 310A and the flat plate portion 3106 flowing to the louvers 311 of the flat plate portion 3106 is shown in an arrow AR34. The airflow direction of the arrow AR35 described above obstructs the airflow of the arrow AR34. As a result, the amount of the air flowing through the louvers 311 of the flat plate portion 3106, that is the amount of the air shown in the arrow AR36 in FIG. 18 is reduced due to the offset portion 350.

The louvers 311 are formed in flat plate portion 310 having the offset portion 350 at a position downstream of the offset portion 350. The air flows from an inlet (the –y side in FIG. 18) of the louvers 311 to an outlet of the louvers 311. In the configuration in which the offset portion 350 is formed by having the portion to be the offset portion 350 recessed toward the inlet of the louvers 311 like the comparative example, the amount of the air flowing through the louver 311 is reduced. Thus, the efficiency of the heat transfer with the air is reduced.

In contrast, in this embodiment, the offset portion 350 is formed by having the portion to be the offset portion 350 recessed toward the outlet of the louvers 311 (i.e., toward the y side in FIG. 17) located on the downstream side of the offset portion 350 of the flat plate portion 310. In this configuration, the amount of the air passing through the louver 311 is increased, thereby improving the efficiency of the heat transfer with the air.

The arrangement of the offset portion 350 described above can be applied for other preceding embodiments.

The present embodiments have been described above with reference to concrete examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those illustrated, and can be changed as appropriate. The combinations of elements included in each of the above described specific examples can be appropriately modified as long as no technical inconsistency occurs.

What is claimed is:

1. A heat exchanger configured to exchange heat between a heat medium and an air, the heat exchanger comprising:

a plurality of tubes each having a tubular shape extending in a horizontal direction, the heat medium flowing through the plurality of tubes; and a plurality of fins each disposed between adjacent ones of the plurality of tubes in a vertical direction, wherein each of the plurality of fins is corrugated and includes:

a plurality of bent portions that are located near the adjacent ones of the plurality of tubes; and a plurality of flat plate portions each of which substantially extends in the vertical direction to connect between two of the plurality of bent portions, adjacent bent portions define a space therebetween in the horizontal direction, each of the plurality of fins includes a pair of slits, at least a portion of the pair of slits extends along one of the plurality of bent portions and has one end in the space between the adjacent bent portions, each of the plurality of fins includes an offset portion formed into a dented shape by having a portion of each of the plurality of fins between the pair of slits recessed into the space between the adjacent bent portions in the horizontal direction, the pair of slits are parallel to each other and extend in the vertical direction, and the offset portion is recessed in the horizontal direction beyond the one end of the pair of slits, and the offset portion is formed such that the adjacent bent portions and the offset portion have an asymmetric structure with respect to a center line between the adjacent bent portions in the horizontal direction.

2. The heat exchanger according to claim 1, wherein a direction in which the air flows along the plurality of fins is defined as a width direction, each of the plurality of tubes has an end in the width direction, and at least one of the pair of slits defining the offset portion is located inward of the end of each of the plurality of tubes in the width direction.

3. The heat exchanger according to claim 2, wherein each of the plurality of fins has a contact area in contact with the adjacent ones of the plurality of tubes, and the offset portion is overlapped with the contact area in the width direction.

4. The heat exchanger according to claim 1, wherein the plurality of bent portions are:

a plurality of upper bent portions near an upper one of the adjacent ones of the plurality of tubes; and a plurality of lower bent portions near a lower one of the adjacent ones of the plurality of tubes, the pair of slits is one of a plurality of pairs of slits, the offset portion is one of a plurality of offset portions, the plurality of pairs of slits and the plurality of offset portions are formed near both at least one of the plurality of upper bent portions and at least one of the plurality of lower bent portions.

5. The heat exchanger according to claim 4, wherein the plurality of offset portions are:

a first offset portion located near the at least one of the plurality of lower bent portions;

a second offset portion located near the at least one of the plurality of upper bent portions, a direction in which the air flows along the plurality of fins is defined as a width direction, each of the plurality of fins is divided into two sections in the width direction by a vertically extending center line, the first offset portion is located in one of the two sections, the second offset portion is located in the other of the two sections.

6. The heat exchanger according to claim 5, wherein a distance between the vertically extending center line and the first offset portion in the width direction is equal to a distance between the vertically extending center line and the second offset portion in the width direction.

7. The heat exchanger according to claim 1, wherein the plurality of bent portions are:

a plurality of upper bent portions located near an upper one of the adjacent ones of the plurality of tubes; and a plurality of lower bent portions located near a lower one of the adjacent ones of the plurality of tubes, and the pair of slits and the offset portion are formed near one of the plurality of lower bent portions.

8. The heat exchanger according to claim 1, wherein a louver for the air to pass therethrough is formed in each of the plurality of flat plate portions having the offset portion, the louver being located at a position downstream of the offset portion in an airflow direction, the louver is open in an opening direction, the offset portion is formed by having the portion of each of the plurality of fins between the pair of slits recessed in the opening direction.

9. The heat exchanger according to claim 8, wherein the air flows through the louver from a first side of each of the plurality of flat plate portions in the horizontal direction to a second side of each of the plurality of flat plate portions in the horizontal direction, and the offset portion is formed by having the portion of each of the plurality of fins between the pair of slits recessed to the second side of each of the plurality of flat plate portions.

10. The heat exchanger according to claim 8, wherein only a first flat plate portion includes the offset portion that is recessed toward the downstream end of the louver in the airflow direction.

11. A heat exchanger configured to exchange heat between a heat medium and an air, the heat exchanger comprising:

a plurality of tubes each having a tubular shape extending in a horizontal direction, the heat medium flowing through the plurality of tubes; and a plurality of fins each disposed between adjacent ones of the plurality of tubes in a vertical direction, wherein each of the plurality of fins is corrugated and includes:

a plurality of bent portions that are located near the adjacent ones of the plurality of tubes; and a plurality of flat plate portions each of which substantially extends in the vertical direction to connect between two of the plurality of bent portions, adjacent bent portions define a space therebetween in the horizontal direction, each of the plurality of fins includes a pair of slits, at least a portion of the pair of slits extends along one of the plurality of bent portions and has one end in the space between the adjacent bent portions, each of the plurality of fins includes an offset portion formed into a dented shape by having a portion of each of the plurality of fins between the pair of slits recessed into the space between the adjacent bent portions in the horizontal direction, the pair of slits are parallel to each other and extend in the vertical direction, a direction in which the air flows along the plurality of fins is defined as a width direction, the pair of slits define an opening therebetween, the offset portion is tilted relative to the width direction such that water flowing along the plurality of bent portions in the width direction is guided to the opening, and the offset portion is tilted relative to the width direction such that a downstream end in the width direction of the offset portion is located closer to one of the plurality of flat plate portions that defines the pair of slits than an upstream end in the width direction of the offset portion to the one of the plurality of flat plate portions.

12. The heat exchanger according to claim 11, wherein only a first flat plate portion includes the offset portion.

* * * * *